US008349529B2

(12) United States Patent
Shimoyama et al.

(10) Patent No.: US 8,349,529 B2
(45) Date of Patent: Jan. 8, 2013

(54) ELECTROPHOTOGRAPHIC PHOTOCONDUCTOR, AND ELECTROPHOTOGRAPHIC METHOD, ELECTROPHOTOGRAPHIC APPARATUS AND PROCESS CARTRIDGE CONTAINING THE ELECTROPHOTOGRAPHIC PHOTOCONDUCTOR

(75) Inventors: Keisuke Shimoyama, Shizuoka (JP); Takaaki Ikegami, Shizuoka (JP); Eiji Kurimoto, Shizuoka (JP); Kohsuke Yamamoto, Kanagawa (JP); Tetsuya Sakuma, Yamanashi (JP); Toshihiko Koizumi, Yamanashi (JP); Hajime Suzuki, Yamanashi (JP); Hideki Nakamura, Yamanashi (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 12/778,590

(22) Filed: May 12, 2010

(65) Prior Publication Data

US 2010/0290807 A1 Nov. 18, 2010

(30) Foreign Application Priority Data

May 12, 2009 (JP) ..... 2009-115640
May 19, 2009 (JP) ..... 2009-120551
May 21, 2009 (JP) ..... 2009-122898

(51) Int. Cl.
*G03G 15/02* (2006.01)

(52) U.S. Cl. ..... 430/58.85; 430/58.05; 430/58.75; 399/159

(58) Field of Classification Search ..... 430/58.05, 430/58.75, 58.85; 399/159
See application file for complete search history.

(56) References Cited

U.S. PATENT DOCUMENTS 6,150,065 A * 11/2000 Kobayashi et al. ..... 430/83
(Continued)

FOREIGN PATENT DOCUMENTS

EP 1930778 A1 * 6/2008
(Continued)

OTHER PUBLICATIONS

US 20100150608 is the English Translation of EP1930778A1.*
(Continued)

*Primary Examiner* — Stewart Fraser
(74) *Attorney, Agent, or Firm* — Oblon, Spivak, McClelland, Maier & Neustadt, L.L.P.

(57) ABSTRACT

An electrophotographic photoconductor including a conductive substrate and a photoconductive layer thereover, wherein the photoconductive layer contains a charge generation agent and a charge transport agent represented by General Formula (A-I), (B-I) or (C-I), and an amine compound represented by General Formula (II):

General Formula (A-I)

-continued

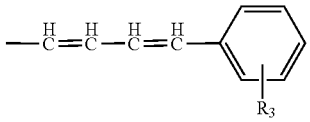

where $R_{1-3}$ each represent hydrogen, halogen or (un)substituted C1-6 alkyl, and n is 1 or 2, General Formula (B-I)

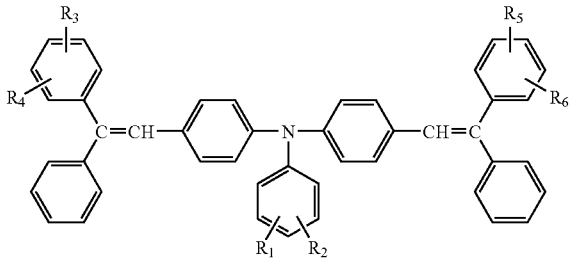

where $R_{1-2}$ each represent C1-6 alkyl and $R_{3-6}$ each represent hydrogen, halogen or (un)substituted C1-6 alkyl, General Formula (C-I)

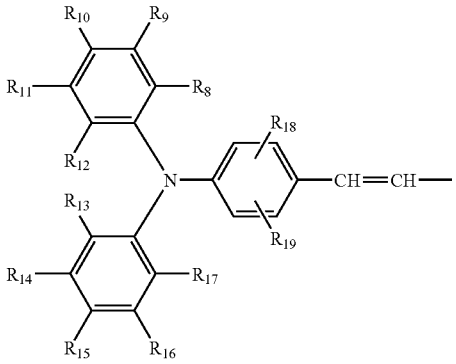

-continued

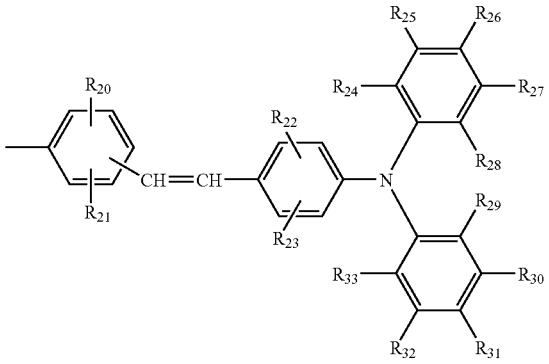

where $R_{8-33}$ each represent hydrogen, C1-4 alkyl, C1-4 alkoxy, or (un)substituted phenyl, and may be identical or different, General Formula (II)

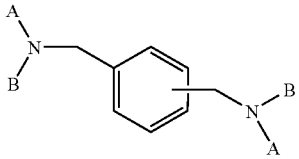

where A and B each represent a group represented by formula (i) or (ii), and may be identical or different:

$—CH_2X$ formula (i)

$—CH_2CH_2Y$ formula (ii)

where X and Y each represent an (un)substituted aromatic group.

15 Claims, 6 Drawing Sheets

U.S. PATENT DOCUMENTS

| | | | | |
|---|---|---|---|---|
| 6,861,188 | B2 | 3/2005 | Ikegami et al. | |
| 7,018,755 | B2 | 3/2006 | Ikegami et al. | |
| 7,314,693 | B2 * | 1/2008 | Ikegami et al. | 430/58.75 |
| 2007/0059039 | A1 | 3/2007 | Shimoyama et al. | |
| 2007/0059618 | A1 | 3/2007 | Kurimoto et al. | |
| 2007/0059619 | A1 | 3/2007 | Shimoyama et al. | |
| 2007/0248901 | A1 | 10/2007 | Shimoyama et al. | |
| 2008/0280221 | A1 | 11/2008 | Shimoyama et al. | |
| 2008/0305426 | A1 | 12/2008 | Kurimoto et al. | |
| 2009/0136260 | A1 | 5/2009 | Ikegami et al. | |
| 2009/0324281 | A1 * | 12/2009 | Tada et al. | 399/111 |
| 2010/0150608 | A1 * | 6/2010 | Mitsumori et al. | 399/159 |
| 2010/0233602 | A1 * | 9/2010 | Yamamoto et al. | 430/58.85 |

FOREIGN PATENT DOCUMENTS

| | | |
|---|---|---|
| JP | 52-20341 | 6/1977 |
| JP | 1-230055 | 9/1989 |
| JP | 3-172852 | 7/1991 |
| JP | 4-56866 | 2/1992 |
| JP | 5-29900 | 5/1993 |
| JP | 05158258 A * | 6/1993 |
| JP | 8-248652 | 9/1996 |
| JP | 2864583 | 12/1998 |
| JP | 2001-175016 | 6/2001 |
| JP | 2002-311607 | 10/2002 |
| JP | 2002-333731 | 11/2002 |
| JP | 2004-21045 | 1/2004 |
| JP | 2006-39528 | 2/2006 |
| JP | 2006-143712 | 6/2006 |
| JP | 2006-206578 | 8/2006 |
| JP | 3901547 | 1/2007 |
| JP | 2007-52408 | 3/2007 |
| JP | 3982868 | 7/2007 |
| JP | 4101676 | 3/2008 |
| JP | 4115055 | 4/2008 |
| JP | 2009-42564 | 2/2009 |
| JP | 4335850 | 7/2009 |

OTHER PUBLICATIONS

English Translation of JP 05158258A.*

* cited by examiner

ELECTROPHOTOGRAPHIC PHOTOCONDUCTOR, AND ELECTROPHOTOGRAPHIC METHOD, ELECTROPHOTOGRAPHIC APPARATUS AND PROCESS CARTRIDGE CONTAINING THE ELECTROPHOTOGRAPHIC PHOTOCONDUCTOR

BACKGROUND OF THE INVENTION

1. Field of the Invention

The present invention relates to an electrophotographic photoconductor mounted in, for example, electrophotographic printers and copiers, and specifically to an electrophotographic photoconductor which is excellent in response, which is applicable to high-speed processing apparatus and which has high ozone and NOx resistances.

The present invention also relates to an electrophotographic method using the electrophotographic photoconductor, an electrophotographic apparatus containing the electrophotographic photoconductor and a process cartridge for use in an electrophotographic apparatus containing the electrophotographic photoconductor.

2. Description of the Related Art

Electrophotographic photoconductors (hereinafter may be referred to as "photoconductors") must have the functions of maintaining surface charge in darkness, generating charges upon receiving light, and transporting charges upon receiving light. They are roughly classified into single-layer photoconductors containing a single layer having these functions, and so-called functionally separated multi-layer photoconductors in which a layer contributing mainly to charge generation is laminated on another layer contributing mainly to maintaining surface charges in darkness and to transporting charges upon receiving light.

Electrophotographic image formation by the aforementioned photoconductors is performed through, for example, Carlson's process. This process includes charging a photoconductor in darkness through corona discharging, forming a latent electrostatic image (in response to, for example, characters or pictures of the original document) on the charged photoconductor surface, developing the formed latent electrostatic image with a toner, transferring/fixing the developed toner image onto a medium such as paper. The photoconductor from which the toner image has been transferred is, for example, charge-eliminated, cleaned for removal of the residual toner, and again charge-eliminated with light; and then is subjected to the next cycle.

In recent years, in view of advantages such as flexibility, thermal stability and film formability, organic compounds have been used in electrophotographic photoconductors, and the use of such electrophotographic photoconductors have been put into practice. In particular, functionally separated multi-layer photoconductors have been mainly used which contain, as a photoconductive layer, a charge generation layer containing a charge generation agent and a charge transport layer containing a charge transport agent. Among others, many negatively charged photoconductors have been proposed. The negatively charged photoconductors contain, as a charge generation layer, a layer on which an organic pigment (serving as a charge generation agent) has been deposited or a layer containing the organic pigment dispersed in a resin, and also contain, as a charge transport layer, a layer containing a low-molecular-weight organic compound (serving as a charge transport agent) dispersed in a resin.

Organic compounds have many advantages unlike inorganic compounds. But, at present, none of them satisfactorily meet all the characteristics required for electrophotographic photoconductors. That is, use of organic compounds causes degradation in image quality after repetitive use due to, for example, a decrease in surface potential, an increase in residual potential, and a change in sensitivity potential. The cause of this degradation has not completely been elucidated. One known cause is that a photoconductive layer is adversely affected by oxidative gases (e.g., ozone and NOx) generated from a corona discharger or present in the atmosphere. Specifically, these oxidative gases cause chemical changes in the materials of the photoconductor, or form adsorptive matter on the photoconductive layer surface, thereby changing the characteristics of the photoconductor; for example, causing a drop of resolution due to a decrease in surface potential, an increase in residual potential and a decrease in surface resistance. As a result, image quality is considerably decreased and the service life of the photoconductor is shortened. In one proposed countermeasure against the above-described disadvantages, an antioxidant and a stabilizer are incorporated into the photoconductive layer for preventing such degradation. For example, many patent documents propose the addition of a hindered phenol-based antioxidant or a hindered amine-based antioxidant (see, for example, Japanese Patent Application Laid-Open (JP-A) No. 01-230055). In addition, JP-A Nos. 03-172852, 2002-333731 and 04-56866 propose the addition of an amine derivative. These proposals achieve a certain advantageous effect.

Nevertheless, since the recent copiers and printers have been required for high-speed processing and downsizing, keen demand has arisen for photoconductors with high durability and response. Production of photoconductors having such high response requires a high-molecular-weight charge transport agent or a charge transport agent having a low ionization potential (Ip). However, these charge transport agents have a low resistance to ozone and NOx and thus, the addition of the conventionally used antioxidant is not sufficient.

BRIEF SUMMARY OF THE INVENTION

The present invention has been made in view of the above. An object of the present invention is to provide an electrophotographic photoconductor which is applicable to high-speed processing in downsized, high-speed copiers and printers, has high response, ozone resistance, NOx resistance, stability and durability, and suffers no degradation of electrical characteristics even after repetitive use.

Another object of the present invention is to provide an electrophotographic method using the electrophotographic photoconductor, an electrophotographic apparatus containing the electrophotographic photoconductor, and a process cartridge for the electrophotographic apparatus containing the electrophotographic photoconductor. These method and apparatus require no replacement of the photoconductor, realize high-speed printing and downsizing, and can stably form high-quality images even after repetitive use.

In order to solve the above problems, the present inventors conducted extensive studies on improvement of ozone and NOx resistances of an electrophotographic photoconductor including, on a conductive substrate, a photoconductive layer containing a charge generation agent and a charge transport agent having high response. As a result, the present inventors have found that, when a specific charge transport agent and a specific amine compound are incorporated into a photoconductive layer, the photoconductive layer is remarkably increased in ozone and NOx resistances, and also that electrophotographic photoconductors having the photoconductive layer exhibit sufficient electrical characteristics to show stable electrophotographic characteristics after repetitive use. The present invention is accomplished on the basis of these findings.

Specifically, the electrophotographic photoconductor of the present invention, the electrophotographic method using the electrophotographic photoconductor, the electrophotographic apparatus containing the electrophotographic photoconductor and the process cartridge for electrophotographic apparatus containing the electrophotographic photoconductor have the following technical features described in <1> to <24> below.

<1> An electrophotographic photoconductor including:

a conductive substrate, and a photoconductive layer provided over the conductive substrate, wherein the photoconductive layer contains a charge generation agent and a charge transport agent represented by any one of the following General Formulas (A-I), (B-I) and (C-I), and an amine compound represented by the following General Formula (II):

General Formula (A-I)

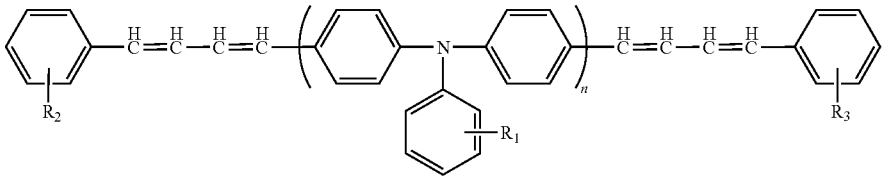

in General Formula (A-I), $R_1$ to $R_3$ each independently represent a hydrogen atom, a halogen atom or a C1 to C6 alkyl group which may have a substituent, and n is 1 or 2, General Formula (B-I)

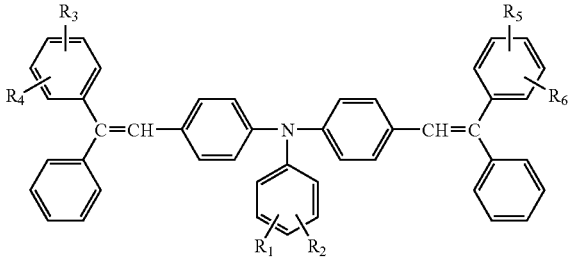

in General Formula (B-I), $R_1$ and $R_2$ each independently represent a C1 to C6 alkyl group and $R_3$ to $R_6$ each independently represent a hydrogen atom, a halogen atom or a C1 to C6 alkyl group which may have a substituent, General Formula (C-I)

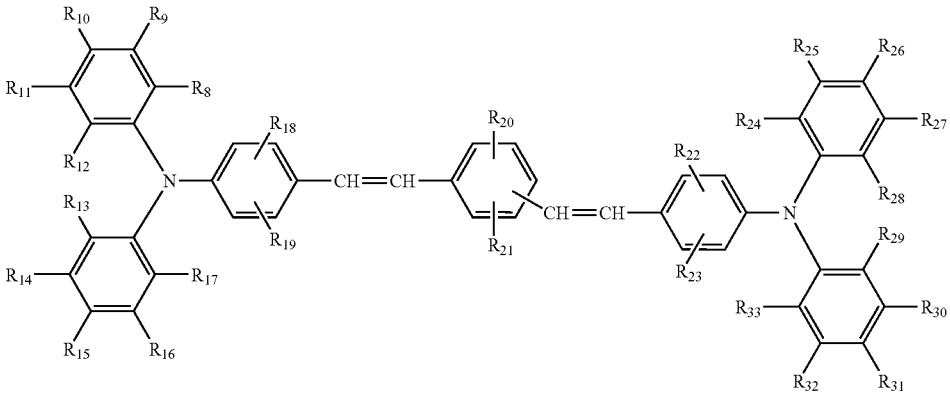

in General Formula (C-I), $R_8$ to $R_{33}$ each independently represent a hydrogen atom, a C1 to C4 alkyl group, a C1 to C4 alkoxy group, or a substituted or unsubstituted phenyl group, and may be identical or different, General Formula (II)

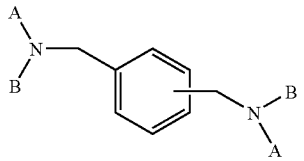

in General Formula (II), A and B each independently represent a group represented by the following formula (i) or (ii), and may be identical or different:

$—CH_2X$ formula (i)

$—CH_2CH_2Y$ formula (ii)

where X and Y each independently represent an aromatic group which may have a substituent.

<2> The electrophotographic photoconductor according to <1> above, wherein the photoconductive layer contains a charge generation layer and a charge transport layer, and the charge generation layer and the charge transport layer are laid over the conductive substrate in this order.

<3> The electrophotographic photoconductor according to <2>, wherein the charge generation layer contains the charge generation agent, and the charge transport layer contains the charge transport agent.

<4> The electrophotographic photoconductor according to any one of <1> to <3> above, wherein the amine compound contains a compound having the following Chemical Formula (IIa):

Chemical Formula (IIa)

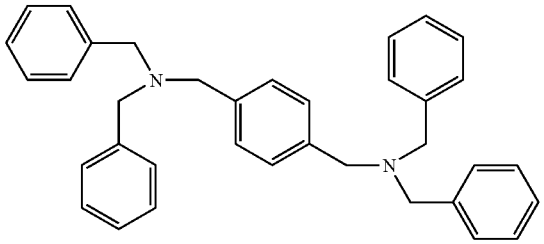

<5> The electrophotographic photoconductor according to any one of <1> to <3> above, wherein the amine compound contains a compound having the following Chemical Formula (IIb):

Chemical Formula (IIb)

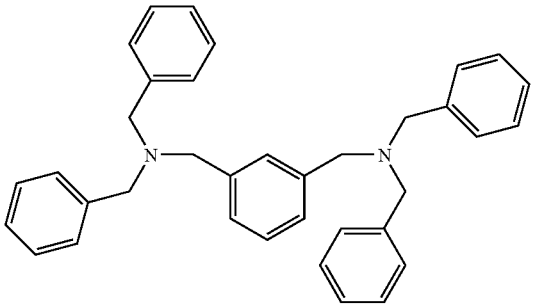

<6> The electrophotographic photoconductor according to any one of <1> to <3> above, wherein the amine compound contains a compound having the following Chemical Formula (IIc):

Chemical Formula (IIc)

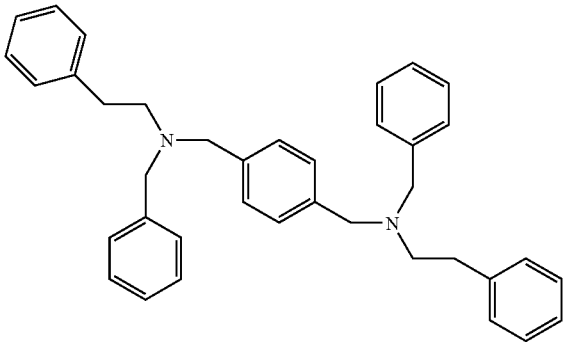

<7> The electrophotographic photoconductor according to any one of <1> to <3> above, wherein the amine compound contains a compound having the following Chemical Formula (IId):

Chemical Formula (IId)

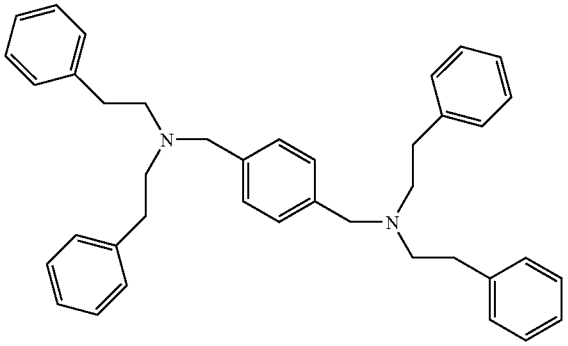

<8> The electrophotographic photoconductor according to any one of <1> to <3> above, wherein the amine compound contains a compound having the following Chemical Formula (IIe):

Chemical Formula (IIe)

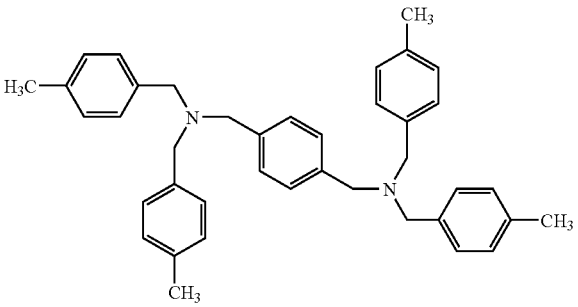

<9> The electrophotographic photoconductor according to any one of <2> to <8> above, wherein the charge transport layer contains a benzotriazole-based UV ray absorber.

<10> The electrophotographic photoconductor according to any one of <2> to <8> above, wherein the charge transport layer contains a phenol-based antioxidant.

<11> An electrophotographic apparatus including:

the electrophotographic photoconductor according to any one of <1> to <10> above, a charging unit configured to charge a surface of the electrophotographic photoconductor, an imagewise exposing unit configured to form a latent electrostatic image on the surface of the electrophotographic photoconductor, a developing unit configured to develop the latent electrostatic image to form a toner image, and a transfer unit configured to transfer the toner image directly or via an intermediate transfer member onto a recording medium, <12> The electrophotographic apparatus according to <11> above, wherein the electrophotographic apparatus is a digital electrophotographic apparatus and the imagewise exposing unit is a LD or LED.

<13> The electrophotographic apparatus according to <11> above, wherein the electrophotographic apparatus is a tandem electrophotographic apparatus including two or more of the electrophotographic photoconductor, two or more of the charging unit, two of more of the developing unit and two or more of the transfer unit.

<14> The electrophotographic apparatus according to any one of <11> to <13> above, further including an intermediate transfer member and an intermediate transfer unit, wherein the transfer unit is configured to primarily transfer the toner image formed on the electrophotographic photoconductor onto the intermediate transfer member, to thereby form an image on the intermediate transfer member, and the intermediate transfer unit is configured to secondarily transfer the image formed on the intermediate transfer member onto the recording medium; and wherein, when the image formed on the intermediate transfer member is color images of a plurality of color toners, the transfer unit is configured to transfer the color images onto the intermediate transfer member in a superposed manner, to thereby form an image on the intermediate transfer member, and the intermediate transfer unit is configured to secondarily transfer the image formed on the intermediate transfer member onto the recording medium at one time.

<15> A process cartridge for electrophotographic apparatus, including:

the electrophotographic photoconductor according to any one of <1> to <10> above, and at least one selected from a charging unit configured to charge a surface of the electrophotographic photoconductor, an imagewise exposing unit configured to form a latent electrostatic image on the surface of the electrophotographic photoconductor, a developing unit configured to develop the latent electrostatic image to form a toner image, a cleaning unit configured to clean the surface of the electrophotographic photoconductor, and a transfer unit configured to transfer the toner image directly or via an intermediate transfer member onto a recording medium.

The present invention can provide an electrophotographic photoconductor exhibiting stable electrical characteristics (e.g., surface, sensitivity and residual potentials) and having extended service life.

The present invention can also provide an electrophotographic method using the electrophotographic photoconductor, an electrophotographic apparatus containing the electrophotographic photoconductor, and a process cartridge for the electrophotographic apparatus containing the electrophotographic photoconductor. These method and apparatus require no replacement of the photoconductor, realize high-speed printing and downsizing, and can stably form high-quality images even after repetitive use.

DETAILED DESCRIPTION OF THE INVENTION (Electrophotographic Photoconductor)

Next, an electrophotographic photoconductor of the present invention will be described in more detail.

Notably, technically preferable various limitations are imposed on the below-described embodiments which are preferred embodiments of the present invention. But, these preferred embodiments should not be construed as limiting the scope of the present invention, unless there is some description of limiting it in the below description.

The electrophotographic photoconductor of the present invention includes at least a conductive substrate and a photoconductive layer; and, if necessary, further includes other layers such as an underlayer.

Figure 1:
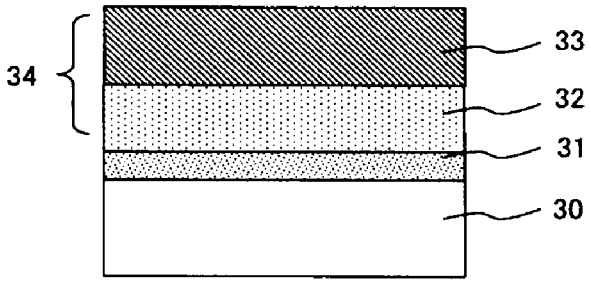
FIG. 1 is a cross-sectional view of a negatively-charged, functionally separated electrophotographic photoconductor according to an embodiment of the present invention.
Figure 2:
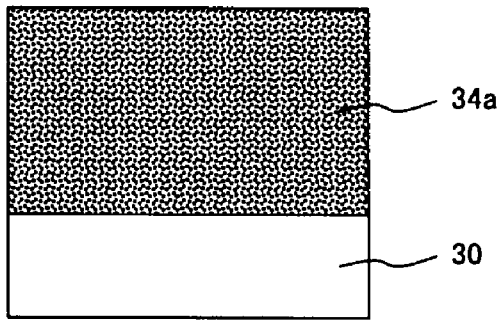
FIG. 2 is a cross-sectional view of a mainly positively-charged, single-layer electrophotographic photoconductor according to another embodiment of the present invention.

FIG. 1 is a cross-sectional view of a negatively-charged, functionally separated electrophotographic photoconductor according to an embodiment of the present invention. FIG. 2 is a cross-sectional view of a mainly positively-charged, single-layer electrophotographic photoconductor according to another embodiment of the present invention. This electrophotographic photoconductor contains a charge generation agent and a charge transport agent in the same layer. In FIGS. 1 and 2, reference numerals 30, 31, 32, 33, 34 and 34*a* respectively denote a conductive substrate, an underlayer which may be optionally provided for improving adhesion, a charge generation layer, a charge transport layer, a functionally separated photoconductive layer consisting of the charge generation layer 32 and the charge transport layer 33, and a single-layer photoconductive layer. Also, the electrophotographic photoconductor of the present invention may be, for example, an inverted multi-layer electrophotographic photoconductor, in which a charge generation layer is formed above a charge transport layer.

(Conductive Substrate)

The conductive substrate 30 usable in the present invention serves as a substrate for other layers as well as an electrode of the photoconductor. The conductive substrate may have any shape such as flexible shapes (e.g. sheet, film, plate and belt) and inflexible shapes (e.g., cylinder), and may be endless. The diameter of the conductive substrate 30 is preferably 60 mm or less, particularly preferably 30 mm or less. Examples of the conductive substrate 30 include processed products of metals and alloys thereof (e.g., aluminum, brass, stainless steel, nickel, chromium, titanium, gold, silver, copper, tin, platinum, molybdenum and indium), and glass and resins which have been subjected to a conducting treatment.

Among them, aluminum alloys of JIS 3000 series, JIS 5000 series, JIS 6000 series, etc., are preferably used for the conductive substrate 30. The conductive substrate 30 is formed by, for example, molding such aluminum alloys with any of generally used methods (e.g., extrusion ironing (EI), extrusion drawing (ED), drawing ironing (DI) and impact ironing (II)). Additionally, the formed conductive substrate 30 may be subjected to surface treatments (e.g., anodizing and polishing) and/or surface lathing with a diamond bite or other tools. Alternatively, it may not be subjected to such treatments; i.e., may be a tube having undergone no surface lathing.

In addition, the base (conductive substrate) 30 may be made of conductive resin or made of resin into which a conducting agent (e.g. metal powder and conductive carbon) has been incorporated.

Furthermore, the conductive substrate may be a glass substrate whose surface has been coated with tin oxide, indium oxide or aluminum iodide for imparting conductivity thereto.

(Photoconductive Layer)

The photoconductive layer is formed of a charge generation layer and a charge transport layer. The charge generation layer and the charge transport layer may be formed on a conductive substrate in this order or in reverse order. Alternatively, the charge generation agent and the charge transport agent may be contained in the same layer.

<Charge Generation Layer>

The charge generation layer preferably contains a charge generation agent.

The method for forming a charge generation layer 32 may be any of various methods. In one exemplary forming method, a phthalocyanine composition (serving as a charge generation agent) and a binder resin are dispersed or dissolved in an appropriate solvent to thereby prepare a coating liquid, which is then applied onto a conductive substrate 30 (a predetermined base), followed by drying as necessary. In other forming methods, an organic photoconductive material is vapor-deposited on the conductive substrate in vacuum; and particles of an organic photoconductive material are dispersed in a resin binder, and the resultant coating liquid is applied onto the conductive substrate. The thus-formed charge generation layer 32 generates charges upon receiving light. In addition to the high charge generation efficiency, the injectability of charges into a charge transport layer 33 is important. It is preferred that the charge injectability is good even in a low electrical field and is not over-dependent on the electrical field.

The thickness of the charge generation layer 32 is not particularly limited, so long as the charge generation layer has a function of generating charges. The thickness thereof is determined based on the light absorption coefficient of the charge generation agent, and is generally 5 μm or smaller, preferably 1 μm or smaller. The charge generation layer 32 mainly contains the charge generation agent but may further contain a charge transport agent, etc. The charge generation agent usable in the present invention is preferably oxytitanium phthalocyanine, since it has a high sensitivity. Among them, Y-type oxytitanium phthalocyanine giving an X-ray diffraction peak shown in FIG. 2 is suitably used in combination with the below-described charge transport agent used in the present invention. Here, the charge transport agent usable in the present invention is not limited to oxytitanium phthalocyanine. Further examples include selenium, selenium-terullium, selenium-arsenic, amorphous silicon, metal-free phthalocyanine, other metal phthalocyanine pigments, azo pigments (e.g., monoazo pigments, disazo pigments, trisazo pigments and polyazo pigments), indigo pigments, threne pigments, toluidine pigments, pyrazoline pigments, perylene pigments, quinacrydone pigments, polycyclic quinone pigments and pyrylium salts. Still further examples of the charge generation agent include phthalocyanine pigments such as titanylphthalocyanine and tin phthalocyanine; and anthoanthorone pigments, perynone pigments, squarylium pigments, thiapyrylium pigments and quinacrydone pigments. These may be used in combination.

Examples of the resin binder used for preparing the coating liquid for the charge generation layer 32 include polycarbonate resins, polyester resins, polyamide resins, polyurethane resins, epoxy resins, polyvinyl butyral resins, polyvinyl acetal resins, vinyl chloride resins, phenoxy resins, silicone resins, methacrylate resins and copolymers thereof. These may be used in combination. Further examples include styrene resins, acryl resins, styrene-acryl resins, ethylene-vinyl acetate resins, polypropylene resins, vinyl chloride resins, chlorinated polyethers, vinyl chloride-vinyl acetate resins, furan resins, nitrile resins, alkyd resins, polyacetal resins, polymethylpentene reins, polyamide resins, polyarylate resins, diarylate resins, polysulfone resins, polyethersulfone resins, polyallylsulfone resins, ketone resins, polyvinyl butyral resins, polyether resins, phenol resins, ethylene vinyl acetate (EVA) resins, acrylonitrile-chlorinated polyethylene-stylene (ACS) resins, acrylonitrile-butadiene-stylene (ABS) resins and epoxyarylate resins. These may be used individually or in combination. Combinational use of resins having different molecular weights is preferred since the formed layer can be improved in hardness and abrasion resistance.

Notably, the above binder resins are preferably used not only for forming the charge generation layer 32 but also for forming the below-described charge transport layer 33. Furthermore, the binder resins are preferably used as a binder resin for forming a single-layer photoconductive layer in the single-layer electrophotographic photoconductor, in which a charge generation agent and a charge transport agent are incorporated into a single photoconductive layer.

The thickness of the charge generation layer 32 is not particularly limited, so long as the charge generation layer has a function of generating charges. The thickness thereof is determined based on the light absorption coefficient of the charge generation agent, and is generally 3 μm or smaller, preferably 1 μm or smaller.

<Charge Transport Layer>

The charge transport layer 33 preferably contains at least a charge transport agent and an amine compound described below. The charge transport layer 33 may be formed by, for example, applying a charge transport agent and a binder resin onto the charge generation layer 32 which is a base of the charge transport layer.

The method for forming the charge transport layer 33 may be any of various methods. In a general, employable method, the charge transport agent and the binder resin are dispersed or dissolved in an appropriate solvent to prepare a coating liquid, which is then applied onto the charge generation layer 32 (base), followed by drying. The binder resin and the solvent may be those exemplified above in respect to the charge generation layer 32.

The charge transport layer 33 is a film in which a charge transport agent is dispersed in a resin binder. The charge transport layer serves as an insulating layer in darkness to maintain charges on the photoconductor, while, upon receiving light, transports charges injected from the charge generation layer 32. The charge transport layer 33 contains a charge transport agent (main component), a resin binder and various additives.

The photoconductive layer 34 or 34*a* in the electrophotographic photoconductor of the present invention contains a charge transport agent represented by any one of General Formulas (A-I), (B-I) and (C-I) and an amine compound (additive) represented by General Formula (II).

General Formula (A-I)

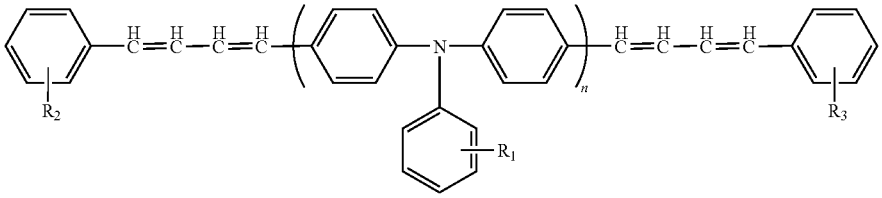

in General Formula (A-I), $R_1$ to $R_3$ each independently represent a hydrogen atom, a halogen atom or a C1 to C6 alkyl group which may have a substituent, and n is 1 or 2.

General Formula (B-I)

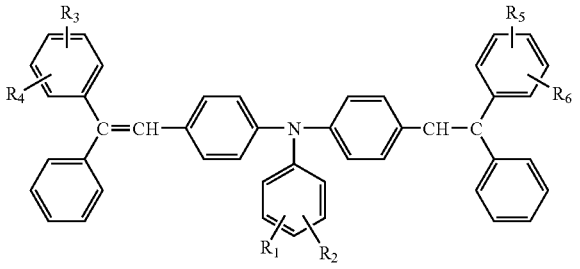

in General Formula (B-I), $R_1$ and $R_2$ each independently represent a C1 to C6 alkyl group and $R_3$ to $R_6$ each independently represent a hydrogen atom, a halogen atom or a C1 to C6 alkyl group which may have a substituent.

General Formula (C-I)

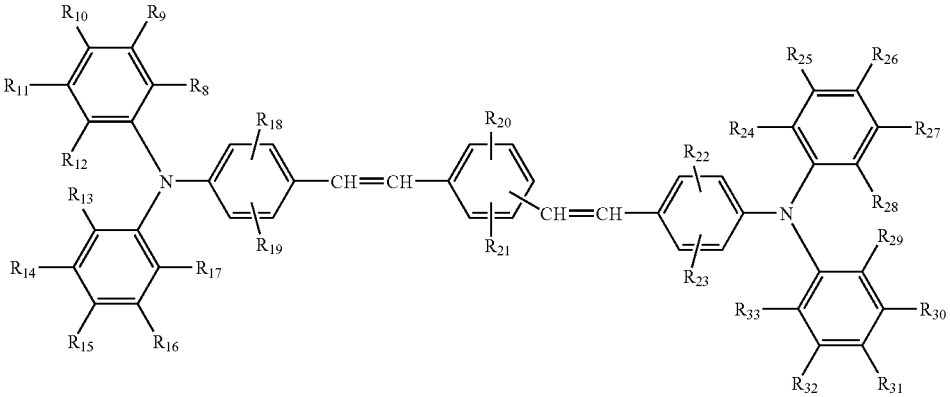

in General Formula (C-I), $R_8$ to $R_{33}$ each independently represent a hydrogen atom, a C1 to C4 alkyl group, a C1 to C4 alkoxy group, or, a substituted or unsubstituted phenyl group, and may be identical or different.

General Formula (II)

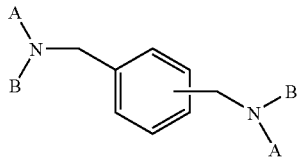

in General Formula (II), A and B each independently represent a group represented by the following formula (i) or (ii), and may be identical or different:

$—CH_2X$ formula (i)

$—CH_2CH_2Y$ formula (ii)

where X and Y each independently represent an aromatic group which may have a substituent.

More preferably, X and Y each independently represent a phenyl group or a tolyl group.

In the electrophotographic photoconductor of the present invention which responds to downsizing and high-speed printing, the above charge transport agent having high mobility is contained in the photoconductive layer 34 or 34*a*. In particular, when the electrophotographic photoconductor is a functionally separated one shown in FIG. 2, this charge transport agent is contained in the charge transport layer 33.

Also, the charge transport layer 33 in the electrophotographic photoconductor of the present invention preferably contains a charge transport agent represented by the following General Formula (I').

General Formula (I')

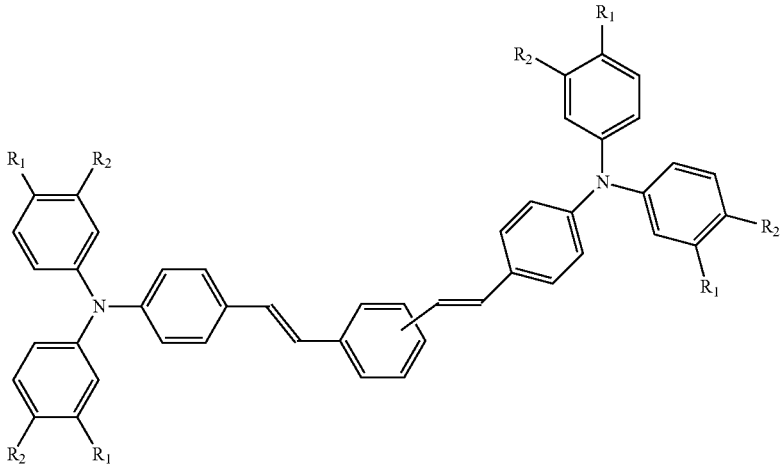

In General Formula (I'), $R_1$ and $R_2$ each independently represent a hydrogen atom, a C1 to C4 alkyl group or a C1 to C4 alkoxy group, and may be identical or different.

More preferably, $R_1$ and $R_2$ each independently represent a hydrogen atom, a methyl group or a methoxy group.

Among the charge transport agents represented by General Formula (A-I), those having the following Chemical Formulas (A-Ia) to (A-Ih) are particularly preferred, since they are excellent in various properties for downsizing and high-speed printing. Next, these particularly preferred compounds will be listed below. However, the compounds usable in the present invention should not be construed as being limited thereto.

Chemical Formula (A-Ia)

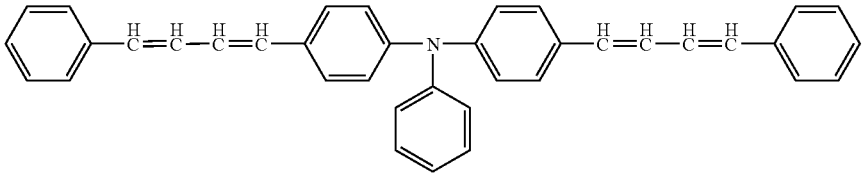

Chemical Formula (A-Ib)

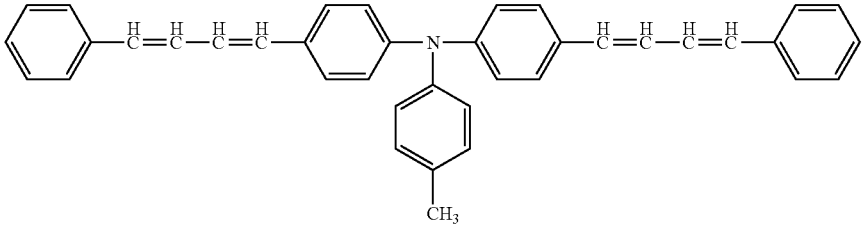

Chemical Formula (A-Ic)

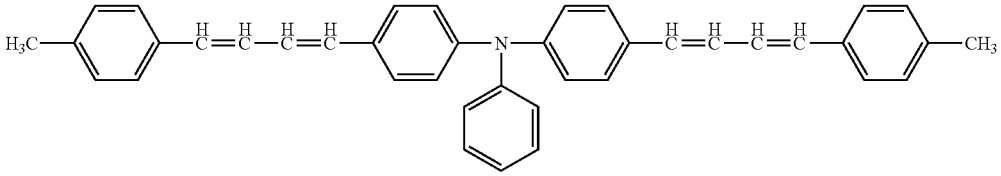

Chemical Formula (A-Id)

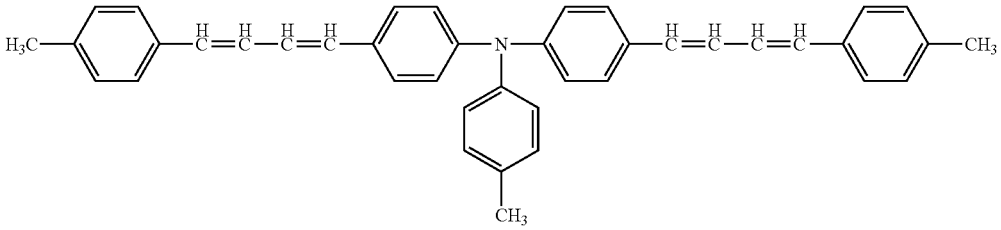

Chemical Formula (A-Ie)

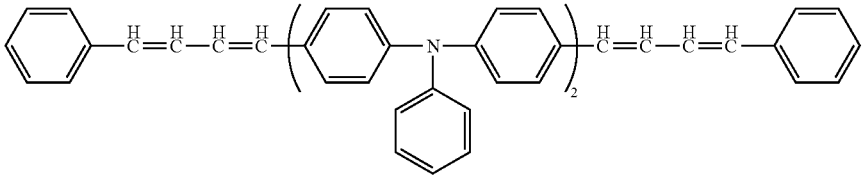

Chemical Formula (A-If)

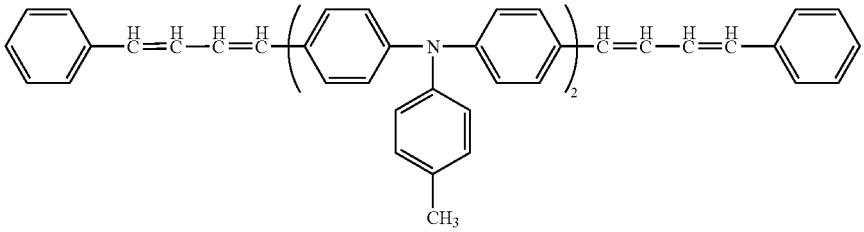

-continued

Chemical Formula (A-Ig)

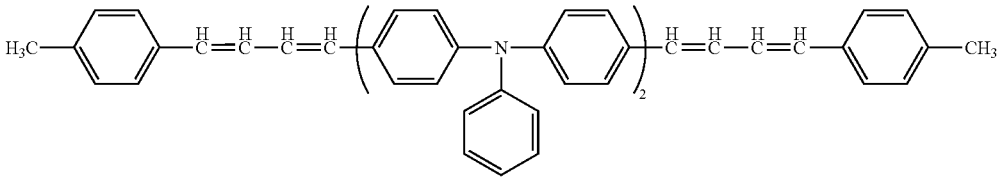

Chemical Formula (A-Ih)

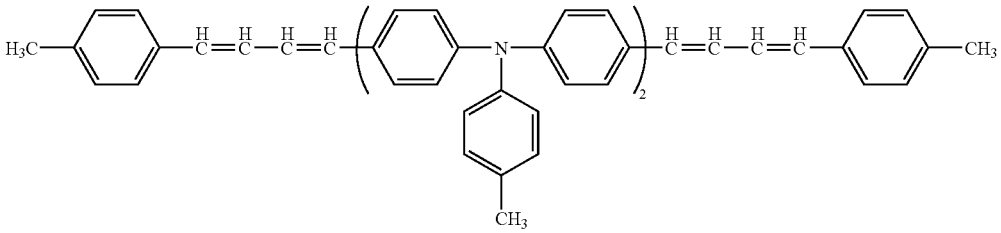

Among the charge transport agents represented by General Formula (B-I), those having the following Chemical Formulas (B-Ia) to (B-Ih) are particularly preferred, since they are excellent in various properties for downsizing and high-speed printing. Next, these particularly preferred compounds will be listed below. However, the compounds usable in the present invention should not be construed as being limited thereto.

Chemical Formula (B-Ia)

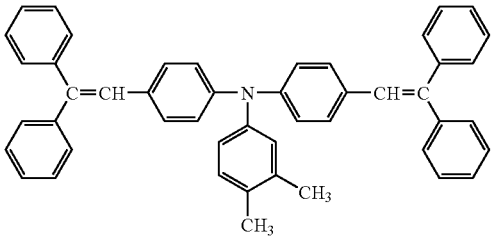

Chemical Formula (B-Ib)

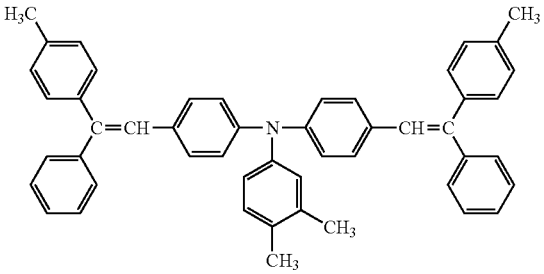

Chemical Formula (B-Ic)

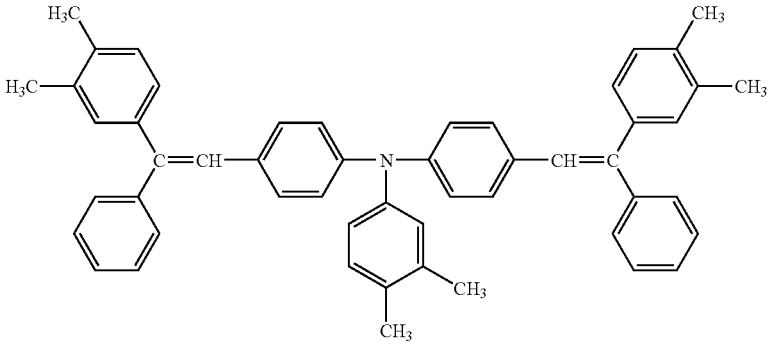

Chemical Formula (B-Id)

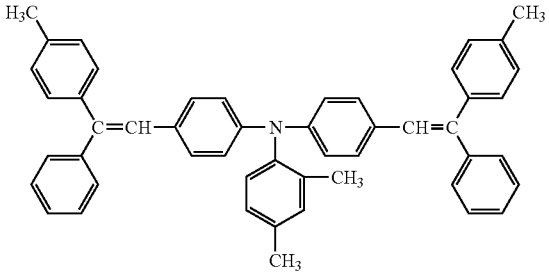

Chemical Formula (B-Ie)

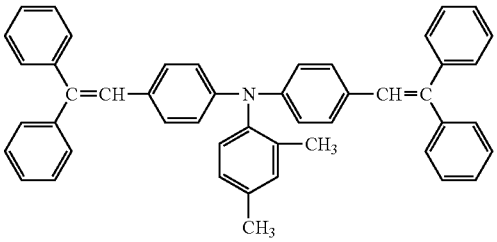

-continued

Chemical Formula (B-If)

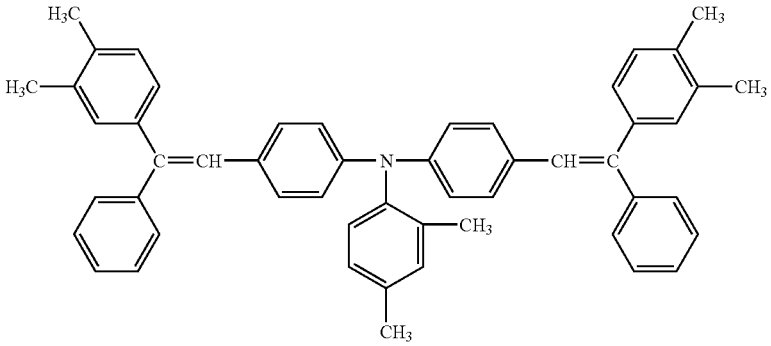

Among the charge transport agents represented by General Formula (C-I), those having the following Chemical Formulas (C-Ia) to (C-Ig) are particularly preferred, since they are excellent in responsiveness. However, the compounds usable in the present invention should not be construed as being limited thereto.

Chemical Formula (C-Ia)

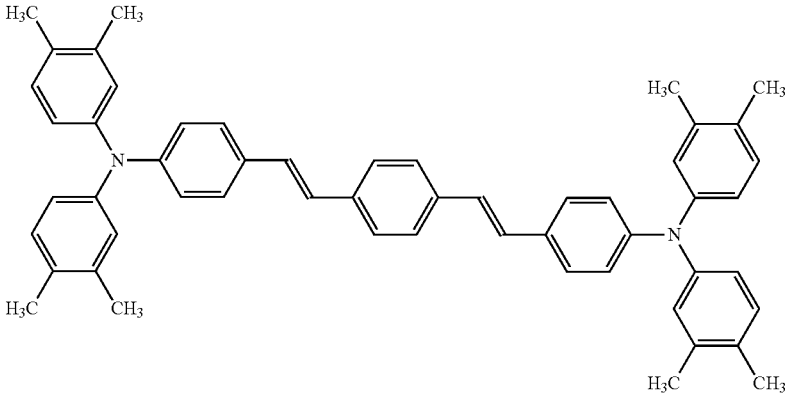

Chemical Formula (C-Ib)

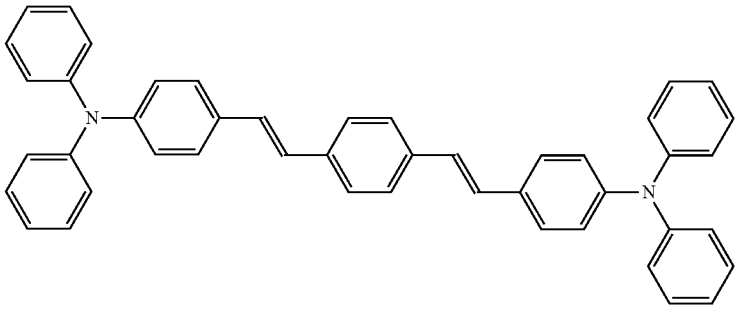

Chemical Formula (C-Ic)

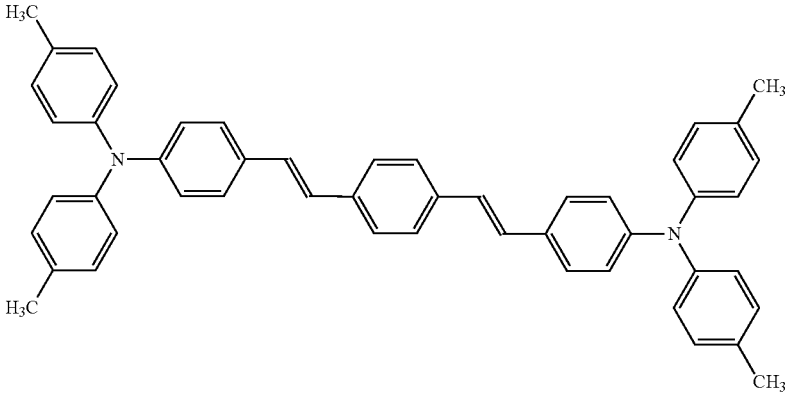

-continued
Chemical Formula (C-Id)
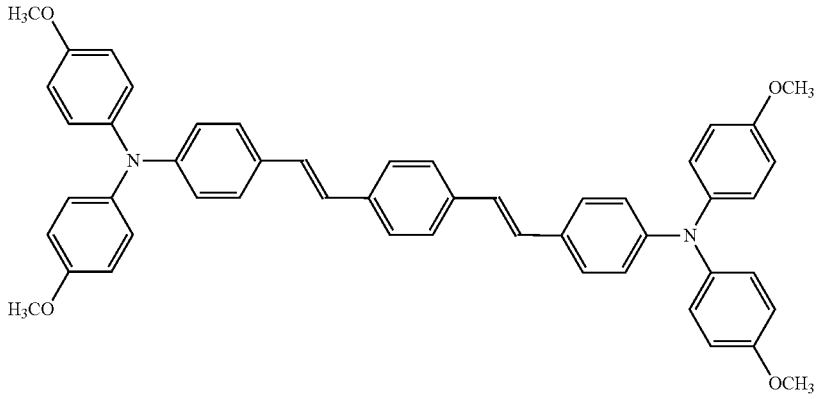
Chemical Formula (C-Ie)
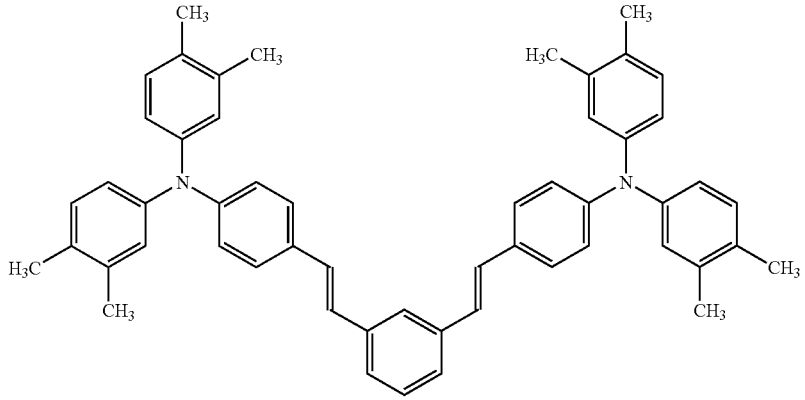
Chemical Formula (C-If)
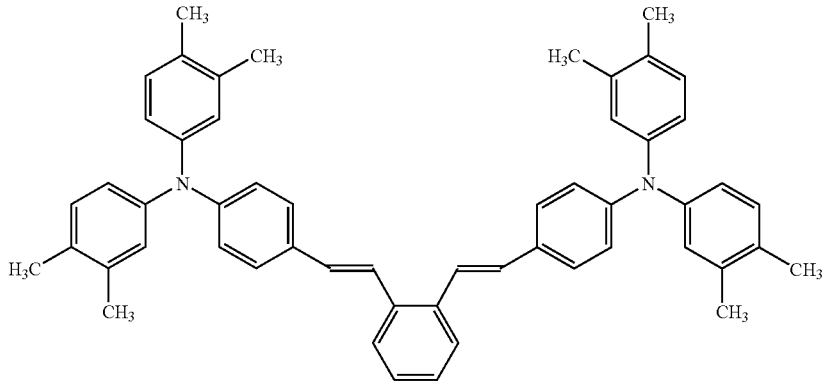
Chemical Formula (C-Ig)
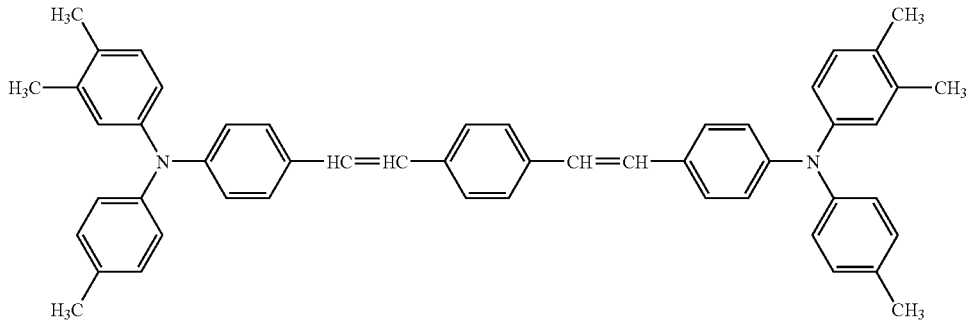

The above amine compound (additive) prevents the electrophotographic photoconductor from being degraded due to ozone or NOx, contributing to a longer service life.

Among the compounds represented by General Formula (II), those having the following Chemical Formulas (IIa) to (IIe) are preferred, since they are excellent in preventing the electrophotographic photoconductor from degradation due to ozone or NOx. Next, these particularly preferred compounds will be listed below. However, the compounds usable in the present invention should not be construed as being limited thereto.

Chemical Formula (IIa)

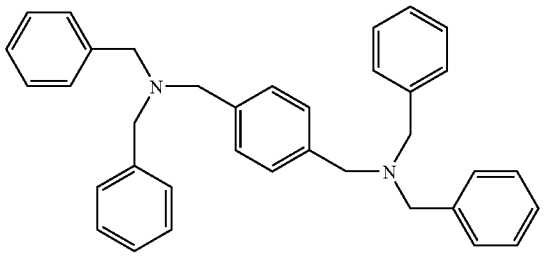

Chemical Formula (IIb)

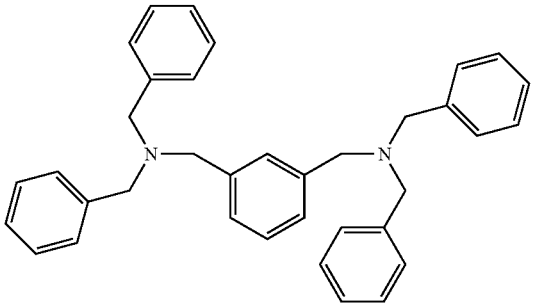

Chemical Formula (IIc)

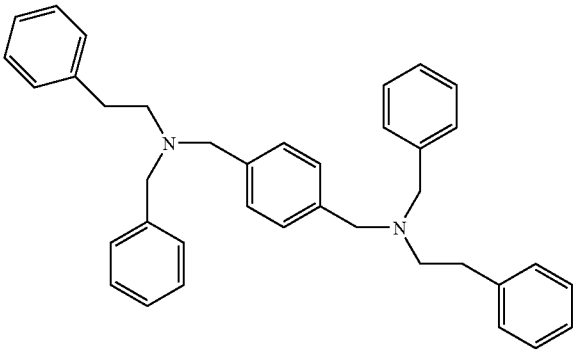

Chemical Formula (IId)

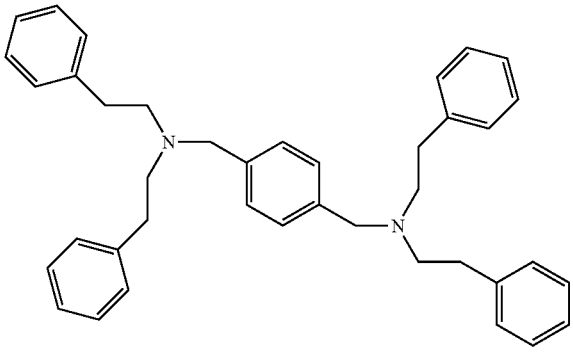

-continued

Chemical Formula (IIe)

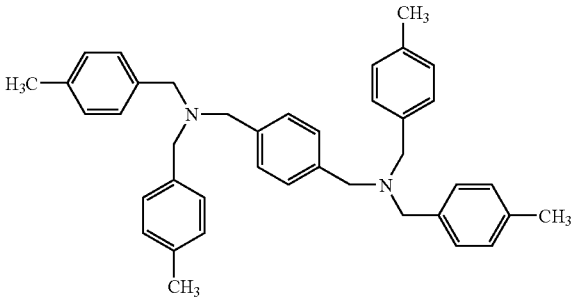

The amount of the charge transport agent represented by any one of General Formulas (A-I), (B-I) and (C-I) contained in the charge transport layer 33 is preferably 0.3 parts by mass to 2.0 parts by mass per 1 part by mass of the resin binder. When the amount is less than 0.3 parts by mass, electrical characteristics are degraded (e.g., residual potential increases), whereas when the amount is more than 2.0 parts by mass, mechanical properties (e.g., abrasion resistance) are degraded.

In addition, the charge transport agent represented by any one of General Formulas (A-I), (B-I) and (C-I) may be used in combination with other charge transport agents. In this case, the content ratio by mass of the charge transport agent represented by any one of General Formulas (A-I), (B-I) and (C-I) to the other charge transport agents is 50:50 to 95:5, preferably 70:30 to 95:5.

Examples of the other charge transport agents include high-molecular-weight conductive compounds (e.g., polyvinylcarbazole, halogenated polyvinylcarbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylenevinylene, polyisothianaphthene, polyaniline, polydiacetylene, polyheptadien, polypyridindiyl, polyquinoline, polyphenylene sulfide, polyferrocenylene, polyperinaphthylene and polyphthalocyanine) and low-molecular-weight conductive compounds such as trinitrofluorenone, tetracyanoethylene, tetracyanoquinodimethane, quinone, diphenoquinone, naphthoquinone, anthraquinone, derivatives thereof, polycyclic aromatic compounds (e.g., anthracene, pyrene and phenanthrene), nitrogen-containing heterocyclic compounds (e.g., indole, carbazole and imidazole), fluorenone, fluorene, oxadiazole, oxazole, pyrazoline, hydrazone, triphenylmethane, triphenylamine, enamine, stilbene and butadiene compounds. Considering high responsiveness, the molecular weight of these compounds is preferably 600 or higher. In addition, a polymer solid electrolyte can be used. Such a polymer solid electrolyte is produced by doping a polymer compound (e.g., polyethylene oxide, polypropylene oxide, polyacrylonitrile or polymethacrylic acid) with metal ions (e.g., Li ions). Furthermore, a charge-transporting organic complex can be used. Such a charge-transporting organic complex is formed of an electron-accepting compound and an electron-donating compound (e.g., tetrathiafulvalene-tetracyanoquinodimethane). These may be used individually or in combination for imparting desired characteristics to the photoconductor.

The amount of the amine compound represented by General Formula (II) contained in the charge transport layer 33 is preferably 0.01 parts by mass to 0.30 parts by mass per 1 part by mass of the charge transport agent. When the amount is less than 0.01 parts by mass, the charge amount of the electrophotographic photoconductor decreases due to ozone or NOx and image blur occurs considerably; whereas when the amount is more than 0.30 parts by mass, residual potential increases.

Examples of the resin binder used for forming the charge transport layer include polycarbonate resins, styrene resins, acrylic resins, styrene-acrylic resins, ethylene-vinyl acetate resins, polypropylene resins, vinyl chloride resins, chlorinated polyether resins, vinyl chloride-vinyl acetate resins, polyester resins, furan resins, nitrile resins, alkyd resins, polyacetal resins, polymethylpentene resins, polyamide resins, polyurethane resins, epoxy resins, polyarylate resins, diarylate resins, polysulfone resins, polyethersulfone resins, polyallylsulfone resins, silicone resins, ketone resins, polyvinyl butyral resins, polyether resins, phenol resins, ethylene-vinyl acetate resins (EVA copolymers), acrylonitrile-chlorinated polyethylene-styrene (ACS) resins, acrylonitrile-butadiene-styrene (ABS) resins and photocurable resins (e.g., epoxy arylate resins). These may be used as is or as a copolymer thereof, and may be used in combination. Use of a mixture of resins having different molecular weights is preferred, since the formed charge transport layer can be improved in hardness and abrasion resistance.

In addition to mechanical, chemical and electrical stabilities and adhesion properties, it is important that the resin binder for the charge transport layer is compatible to the charge transport agent.

The thickness of the charge transport layer 33 is preferably 3 μm to 50 μm, more preferably 10 μm to 40 μm, particularly preferably 15 μm to 40 μm, for maintaining a practically effective surface potential.

The thickness of the single-layer photoconductive layer 34*a* is preferably 3 μm to 50 μm, more preferably 10 μm to 40 μm, for maintaining a practically effective surface potential.

Here, the single-layer photoconductive layer 34*a* is a layer in which the charge generation agent and the charge transport agent are dispersed in the resin binder and which has both the charge-generating function and the charge-transporting function in the single layer. Also in this single-layer photoconductive layer 34*a*, there can be used similarly the materials (charge generation agents, charge transport agents and resin binders) described above for the multi-layer photoconductive layer (formed of the charge generation layer 32 and the charge transport layer 33).

In the case of the single-layer photoconductive layer 34*a*, an electron transport agent is preferably used as other charge transport agents for attaining high sensitivity. Examples of the electron transport agent include trinitrofluorenone, tetracyanoethylene, tetracyanoquinodimethan, quinone, diphenoquinone, naphthoquinone, anthraquinone and derivatives thereof; and polycyclic aromatic compounds such as anthracene, pyrene and phenanthrene.

In the single-layer photoconductive layer 34*a*, the amount of the charge generation agent contained in the photoconductive layer 34*a* is suitably 0.1% by mass to 30% by mass, preferably 0.5% by mass to 5% by mass. When the concentration of the charge generation agent is low, the sensitivity of the photoconductor tends to decrease; whereas when the concentration thereof is high, the chargeability and film strength thereof tend to decrease.

The amount of the charge transport agent represented by any one of General Formulas (A-I), (B-I) and (C-I) is preferably 0.3 parts by mass to 2.0 parts by mass per 1 part by mass of the resin binder. The amount of the electron transport agent is preferably 0.3 parts by mass to 2.0 parts by mass per 1 part by mass of the resin binder. The amount of the amine compound represented by General Formula (II) is preferably 0.01 parts by mass to 0.30 parts by mass per 1 part by mass of the charge transport agent. When the amount of the amine compound is less than 0.01 parts by mass, the photoconductor involves disadvantageous problems such as a great change in image density due to degradation of ozone resistance or NOx resistance. Whereas when the amount thereof is more than 0.30 parts by mass, the photoconductor is degraded in electrical properties; e.g., residual potential increases.

<Other Additives>

Various additives may be added to the coating liquid for producing the electrophotographic photoconductor of the present invention so as not to impede characteristics of the formed photoconductor. Examples of the additives include antioxidants, UV ray absorbers, radical-trapping agents, softeners, hardeners and crosslinking agents. In particular, use of an antioxidant and a UV ray absorber in combination with the amine compound represented by General Formula (II) may further contribute to improvement in durability of the photoconductor. Among others, an amine-based antioxidant, a phenol-based antioxidant, a sulfur-containing antioxidant or a benzotriazole-based UV ray absorber is preferably incorporated into the photosensitive layer 34 or 34*a*. In particular, use of the benzotriazole-based UV ray absorber and/or a hindered phenol-based antioxidant in combination with the amine compound represented by General Formula (II) contributes to improvement in durability of the photoconductor. The amine compound represented by General Formula (II) may be used as an antioxidant.

Examples of the phenol-based antioxidant include monophenol-based antioxidants such as 2,6-di-tert-butylphenol, 2,6-di-tert-4-methoxyphenol, 2-tert-butyl-4-methoxyphenol, 2,4-dimethyl-6-tert-butylphenol, 2,6-di-tert-butyl-4-methylphenol, butylated hydroxyanisole, stearyl β-(3,5-di-tert-butyl-4-hydroxyphenyl)propionate, α-tocopherol, β-tocopherol and n-octadecyl-3-(3'-5'-di-tert-butyl-4'-hydroxyphenyl)propionate; and polyphenol-based antioxidants such as 2,2'-methylenebis(6-tert-butyl-4-methylphenol), 4,4'-butylidene-bis-(3-methyl-6-tert-butylphenol), 4,4'-thio-bis-(6-tert-butyl-3-methylphenol), 1,1,3-tris(2-methyl-4-hydroxy-5-tert-butylphenyl)butane, 1,3,5-trimethyl-2,4,6-tris (3,5-di-tert-butyl-4-hydroxybenzyl)benzene and tetrakis (methylene-3-(3,5-di-tert-butyl-4-hydroxyphenyl) propionate)methane. These antioxidants may be used individually or in combination in the photosensitive layer 34 or 34*a*.

Examples of the amine-based antioxidant include N-phenyl-1-naphthylamine, N-phenyl-N'-isopropyl-p-phenylenediamine, N,N-diethyl-p-phenylenediamine, N-phenyl-N'-ethyl-2-methyl-p-phenylenediamine, N-ethyl-N-hydroxyethyl-p-phenylenediamine, alkylated diphenylamine, N,N'-diphenyl-p-phenylenediamine, N,N'-diallyl-p-phenylenediamine, N-phenyl-1,3-dimethylbutyl-p-phenylenediamine, 4,4'-dioctyl-diphenylamine, 4,4'-dioctyl-diphenylamine, 6-ethoxy-2,2,4-trimethyl-1,2-dihydroquinoline, 2,2,4-trimethyl-1,2-dihydroquinoline, N-phenyl-β-naphthylamine and N,N'-di-2-naphthyl-p-phenylenediamine. These antioxidants may be used individually or in combination in the photosensitive layer 34 or 34*a*.

Examples of the sulfur-containing antioxidants include dilauryl-3,3-thiodipropionate, ditridecyl-3,3-thiodipropionate, dimyristyl-3,3-thiodipropionate, distearyl-3,3-thiodipropionate, laurylstearyl-3,3-thiopropionate, bis[2-methyl-4-(3-n-alkyl $C_{12}$ to $C_{14}$)thiopropionate)-5-t-butylphenyl]sulfide, pentaerythritol tetra(β-lauryl-thiopropionate)ester, 2-mercaptobenzimidazole and 2-mercapto-6-methylbenzimidazole. These antioxidants may be used individually or in combination in the photosensitive layer 34 or 34*a*.

Examples of the UV ray absorber include benzotriazole-based UV ray absorbers such as 2-(5-methyl-2-hydroxyphenyl)benzotriazole, 2-(2-hydroxy-3,5-bis(α,α-dimethylbenzyl)phenyl)-2H-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole and 2-(2'-hydroxy-5'-tert-octylphenyl)benzotriazole; and salicylic acid-based UV ray absorbers such as phenyl salicylate, p-tert-butylphenyl salicylate and p-octylphenyl salicylate, with benzotriazole-based UV ray absorbers being particularly preferred.

The amount of the antioxidant and UV ray absorber incorporated into the electrophotographic photoconductor of the present invention is preferably 1 part by mass to 20 parts by mass, particularly preferably 3 parts by mass to 20 parts by mass, per 100 parts by mass of the charge transport agent.

(Other Layers)

<Underlayer>

Also, an underlayer 31 may be formed on the conductive substrate 30. The underlayer has functions of, for example, improving adhesion between the layers, preventing leak current from the conductive substrate 30 (e.g., an aluminum tube) (barrier function), and covering defects formed in the surface of the aluminum tube. Specifically, the underlayer 31 is, for example, a layer made mainly of resin or an oxide film (e.g., ALUMITE) and is optionally formed for the purposes of, for example, preventing unnecessary charges from being injected into the photoconductive layer 34 or 34*a* from the conductive substrate 30, covering defects in the surface of the conductive substrate 30 and improving adhesion between the photoconductive layer 34 or 34*a* and the adjacent layer(s). Examples of the resin (resin binder) mainly forming the underlayer 31 include various resins such as polyethylene resins, polypropylene resins, polystyrene resins, acrylic resins, vinyl chloride resins, vinyl acetate resins, polyurethane resins, epoxy resins, polyester resins, melamine resins, silicone resins, polybutyral resins, polyvinyl butyral resins, polyamide resins, polyimide resins, polycarbonate resins, Nylon resins and alkyd resins; and copolymers thereof. These may be appropriately used in combination. The underlayer 31 may be made of a single resin or a mixture of two or more resins. Also, a metal compound, carbon, silica, resin powder, etc. may be dispersed in the underlayer 31. Further, in order to improve its characteristics, various pigments, an electron-accepting compound, an electron-donating, etc. may be incorporated into the underlayer 31. Also, metal oxide microparticles, etc. may be incorporated into the resin binder. Examples of the metal oxide microparticles employable include $SiO_2$, $TiO_2$, $In_2O_3$ and $ZrO_2$.

The thickness of the underlayer 31 depends on the composition of the underlayer, but can be adjusted as desired in such a range that adverse effects such as an increase in the residual potential after repetitive use are not caused. The thickness is generally 0.1 μm to 50 μm, preferably 0.5 μm to 20 μm.

<Surface Protective Layer>

In addition, as a surface protective layer on the photosensitive layer 34 or 34*a*, an organic thin film is formed of, for example, polyvinyl formal resin, polycarbonate resin, fluorine-containing resin, polyurethane resin or silicone resin; or a thin film with a siloxane structure is made of a hydrolyzate of a silane coupling agent. Provision of the surface protective layer is preferred from the viewpoint of increasing durability of the photoconductor. Also, the surface protective layer may be provided for the purpose of increasing other performances than durability.

Furthermore, use of a dispersion stabilizer, an antisettling agent, a color separation inhibitor, a leveling agent, a defoamer, a thickening agent and a delustering agent can improve the appearance of the finished photoconductor and the service life of the coating liquid.

If necessary, an electron-accepting compound may be further incorporated into the photoconductive layer 34 or 34*a* of the multi-layer or single-layer photoconductor, in order to improve its sensitivity, reduce the residual potential, or reduce a change in characteristics after repetitive use. Examples of the electron-accepting compound include compounds having high electron affinity such as succinic anhydride, maleic anhydride, dibrome-succinic anhydride, phthalic anhydride, 3-nitro phthalic anhydride, 4-nitro phthalic anhydride, pyromellitic anhydride, pyromellitic acid, trimellitic acid, trimellitic anhydride, phthalimide, 4-nitrophthalimide, tetracyanoethylene, tetracyano quinodimethane, chloranyl and bromanil, o-nitro benzoic acid, and p-nitro benzoic acid.

Examples of solvents used for forming the coating liquid include alcohols such as methanol, ethanol, n-propanol, i-propanol and butanol; saturated aliphatic hydrocarbons such as pentane, hexane, heptane, octane, cyclohexane and cycloheptane; aromatic hydrocarbons such as toluene and xylene; halogenated (chlorinated) hydrocarbons such as dichloromethane, dichloroethane, chloroform and chlorobenzene; ethers such as dimethyl ether, diethyl ether, dimethoxyethane, tetrahydrofuran (THF), methoxyethanol, dioxolane, dioxan and anisol; ketones such as acetone, methyl ethyl ketone, methyl isobutyl ketone and cyclohexanone; esters such as ethyl formate, propyl formate, methyl acetate, ethyl acetate, propyl acetate, butyl acetate and methyl propionate; N,N-dimethylformamide; and dimethylsulfoxide. These may be used individually or in combination. Among them, ketone solvents, ester solvents, ether solvents and halogenated hydrocarbon solvents are preferred. These solvents may be used individually or in combination.

Notably, the above solvents are preferably used not only for forming the charge generation layer 32 but also for forming the below-described charge transport layer 33. Furthermore, the solvents are preferably used as a solvent for forming a single-layer photoconductive layer in the single-layer electrophotographic photoconductor, in which a charge generation agent and a charge transport agent are incorporated into the single photoconductive layer.

[Electrophotographic Apparatus and Electrophotographic Method]

An electrophotographic apparatus according to the present invention includes the above-described electrophotographic photoconductor, a charging unit configured to charge the surface of the electrophotographic photoconductor, an imagewise exposing unit configured to form a latent electrostatic image on the surface of the electrophotographic photoconductor, a developing unit configured to develop the latent electrostatic image so as to form a toner image, and a transfer unit configured to transfer the toner image onto a recording medium; and, if necessary, further includes other appropriately selected units. Examples of the other units include a cleaning unit, a charge-eliminating unit, a recycling unit and a controlling unit.

First Embodiment

Next, the electrophotographic apparatus and electrophotographic method according to the present invention will be described in detail while referring to the drawings.

Figure 3:
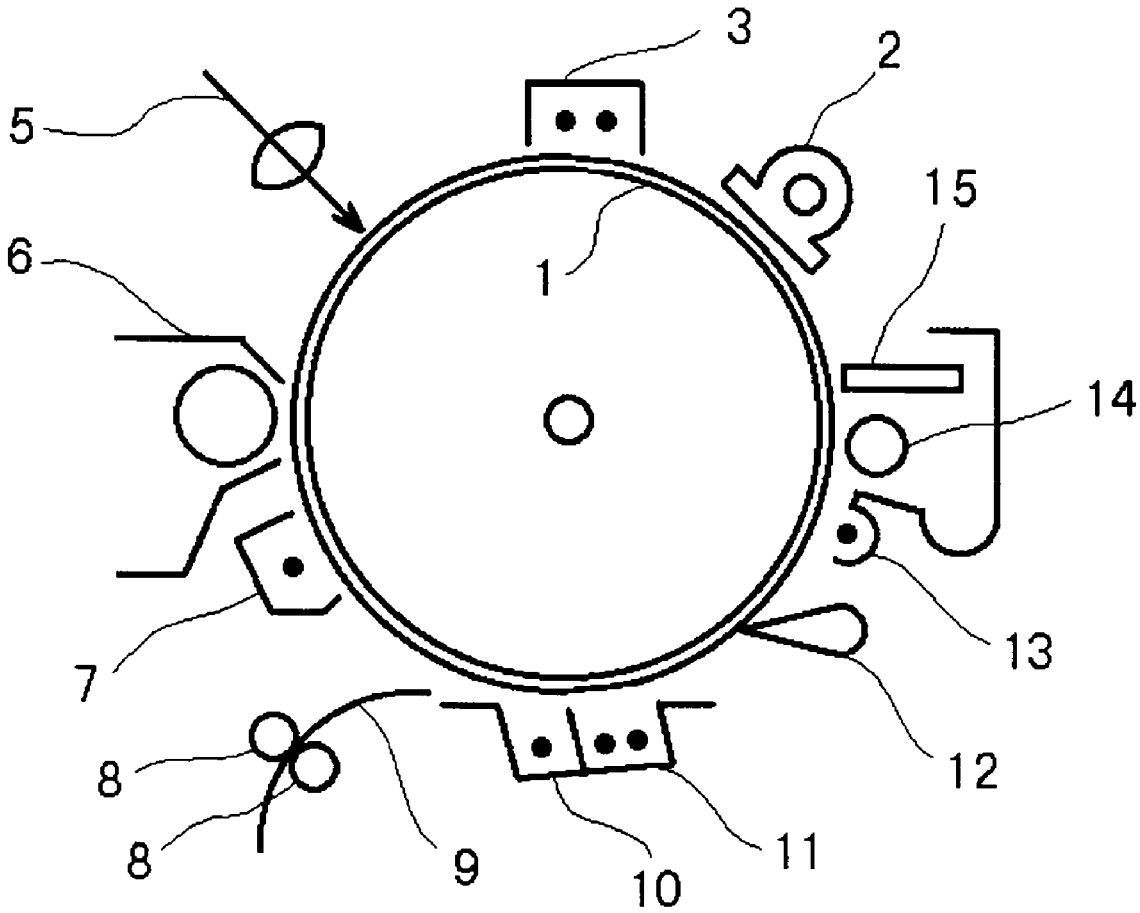
FIG. 3 is a schematic cross-sectional view of the configuration of an electrophotographic apparatus according to a first embodiment of the present invention.

FIG. 3 schematically illustrates the electrophotographic apparatus and electrophotographic method of the present invention and, specifically, illustrates the configuration of an electrophotographic apparatus according to a first embodiment of the present invention.

In FIG. 3, a photoconductor 1 is the above-described electrophotographic photoconductor according to the present invention. The photoconductor 1 has a drum shape, but may be provided in the form of a sheet, or has an endless belt shape.

In the embodiment illustrated in FIG. 3, while the photoconductor 1 having a drum shape is being rotated counterclockwise by an unillustrated driving unit, an image is formed on the photoconductor 1 with units provided therearound by an electrophotographic method. Next will be described sequentially each step of the electrophotographic method.

(Charging Unit and Step)

First, the surface of the photoconductor 1 is uniformly charged with a charger 3 serving as a charging unit. The charger 3 may be appropriately selected from those conventionally known in the art depending on the characteristics of the photoconductor 1 and the developing toner used, and may be any charger so long as it can charge the surface of the photoconductor 1 at a predetermined polarity (either positively or negatively) so as to have a predetermined potential. Examples of the charger 3 include corotrons, scorotrons, solid state chargers and charging rollers.

(Imagewise Exposing Unit and Step)

Next, the uniformly charged surface of the photoconductor 1 is exposed to light with an imagewise exposing portion 5 serving as an imagewise exposing unit, whereby a latent electrostatic image is formed. A light source used in the imagewise exposing portion 5 may be a usual light-emitting device such as a fluorescent lamp, a tungsten lamp, a halogen lamp, a mercury lamp, a sodium lamp, a light-emitting diode (LED), a laser diode (LD) or an electroluminescence (EL) lamp. The light source is preferably a light-emitting diode or a laser diode. Also, a filter may be provided between the photoconductor 1 and the imagewise exposing portion 5 so that the photoconductor is irradiated with light having a desired wavelength during imagewise exposure. The filter may be, for example, a sharp-cut filter, a band-pass filter, a near-infrared cut filter, a dichroic filter, an interference filter or a color conversion filter.

(Developing Unit and Step)

The latent electrostatic image formed on the surface of the photoconductor 1 is developed with a toner by a developing unit 6 serving as the developing unit. Specifically, the latent electrostatic image is developed by the developing unit 6 to form a toner image; i.e., a visible image. The developing unit 6 may be appropriately selected from those conventionally known in the art depending on the toner used. The developing unit 6 is, for example, a developing unit having a one-component developing system or a developing unit having a two-component developing system. These developing units may be for magnetic toners or non-magnetic toners.

(Transfer Unit and Step)

The toner image on the photoconductor 1 is transferred to a position facing a transfer charger 10 serving as the transfer unit, while the photoconductor 1 is being rotated. The transfer charger 10 may be the chargers described above in relation to the charger 3, but as illustrated in FIG. 3, an advantageously used charger includes a transfer charger 10 and a separation charger 11 in combination. Further, in order to improve the transfer efficiency, preferably, the toner image is pre-charged with a pre-transfer charger 7 provided upstream of the transfer charger 10 (in the direction in which the photoconductor 1 is rotated). The transfer charger 7 may be the chargers described above in relation to the charger 3.

Also, a recording paper 9 (recording medium) is transferred with, for example, registration rollers 8 to a position where the photoconductor 1 faces the transfer charger 10, in order for the toner image to be transferred onto the recording paper 9 at a desired position.

Then, the toner image is transferred onto the recording paper 9 with the transfer charger 10 in a position where the toner image on the photoconductor 1 faces the recording paper 9.

Notably, the recording paper 9 onto which the toner image has been transferred reach a separation claw 12 while the photoconductor 1 is being rotated, and then is separated from the surface of the photoconductor 1 with the separation claw 12. The thus-separated recording paper is transferred to and fixed at a fixing step (whose explanation is omitted) to be discharged outside the electrophotographic apparatus.

(Cleaning Unit and Step)

Here, the photoconductor 1, from which the toner image has been transferred onto the recording paper 9 by the transfer charger 10 and the recording paper has been separated with the separation claw 12, has, on its surface, deposited matter such as paper dust and so-called post-transfer residual toner (i.e., the toner image remaining after transfer onto the recording paper 9). Thus, a fur brush 14 and a cleaning blade 15, each serving as the cleaning unit, are used to remove the deposited matter from the surface of the photoconductor 1. In addition to the fur brush 14 and the cleaning blade 15, the cleaning unit may be also those conventionally known in the art such as a magfur brush. Alternatively, either the fur brush or the cleaning blade may be used. Notably, in order to improve the cleaning efficiency, the photoconductor is preferably pre-charged with a pre-cleaning charger 13 before being treated with the cleaning unit. The pre-cleaning charger 13 may be the chargers described above in relation to the charger 3.

(Charge-Eliminating Unit and Step)

The surface of the photoconductor 1, from which the deposited matter has been removed with the cleaning unit, is charge-eliminated through light irradiation with a charge-eliminating lamp 2 serving as the charge-eliminating unit, whereby the electrophotographic image forming process is completed once. By repeating the electrophotographic image forming process, an image can be formed on a plurality of recording media.

The charge-eliminating unit (e.g., the charge-eliminating lamp 2) may be those conventionally known in the art, and may be the light-emitting devices described above in relation to the imagewise exposing portion 5.

In the above-described electrophotographic image forming method, the electrophotographic photoconductor 1 is positively (or negatively) charged, and then imagewise exposed to light, so as to form a positively (or negatively) charged latent electrostatic image on the photoconductor 1. The thus-formed positively (or negatively) charged latent electrostatic image is developed with negatively (or positively) charged toner particles (electrically detecting microparticles) to form a positive image, or with positively (or negatively) charged toner particles to form a negative image. The polarity of the charged electrophotographic photoconductor 1 or the toner used for development may be adjusted to be positive or negative as desired.

Also, the light sources used in the image exposing portion 5 are not limited to the embodiment illustrated in FIG. 3, and may be used in, for example, the transfer step, charge-eliminating step, cleaning step and pre-exposing step, which each perform light irradiation.

Second Embodiment

Figure 4:
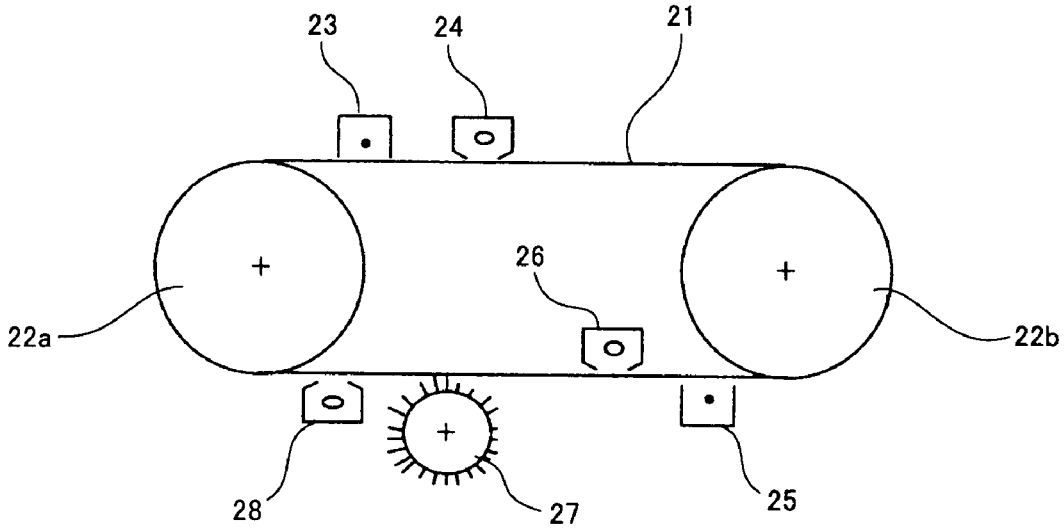
FIG. 4 is a schematic cross-sectional view of the configuration of an electrophotographic apparatus according to a second embodiment of the present invention.

FIG. 4 schematically illustrates the configuration of an electrophotographic apparatus according to a second embodiment of the present invention.

A photoconductor 21 includes at least a photoconductive layer 34 or 34*a* and is driven with drive rollers 22*a* and 22*b*. The following cycle is repeated on the photoconductor: charging with a charger 23 serving as the charging unit, imagewise exposing with a light source 24 serving as the imagewise exposing unit, developing with an unillustrated developing device serving as the developing unit, transferring with a transfer charger 25 serving as the transfer unit, pre-clean exposing with a light source 26, cleaning with a cleaning brush 27 serving as the cleaning unit, and charge-eliminating with a light source 28 serving as the charge-eliminating unit. In FIG. 4, the photoconductor 21 is irradiated with light for pre-cleaning exposure from the side of the conductive substrate 30 (needless to say, the substrate is transmissive to light in this case).

The electrophotographic image forming process performed using the electrophotographic apparatus illustrated in FIG. 4 is one exemplary embodiment of the present invention. Needless to say, it can be performed in other embodiments. For example, in FIG. 4, pre-cleaning exposure is performed from the side of the conductive substrate 30. But, it may also be performed from the side of the photoconductive layer 34 or 34*a*. Furthermore, light irradiation for image exposure and charge-elimination is performed from the side of the conductive substrate 30.

Also, in this figure, imagewise exposure, pre-cleaning exposure and charge-eliminating exposure are light-applying steps. In addition, other known light-applying steps (e.g., a pre-transfer exposing step and a pre-exposing step for imagewise exposure) may be performed to apply light to the photoconductor 21.

Third Embodiment

Next, description will be given to an embodiment of an electrophotographic printer (hereinafter referred to simply as a "printer") as a full color electrophotographic apparatus to which the present invention is applied.

Figure 5:
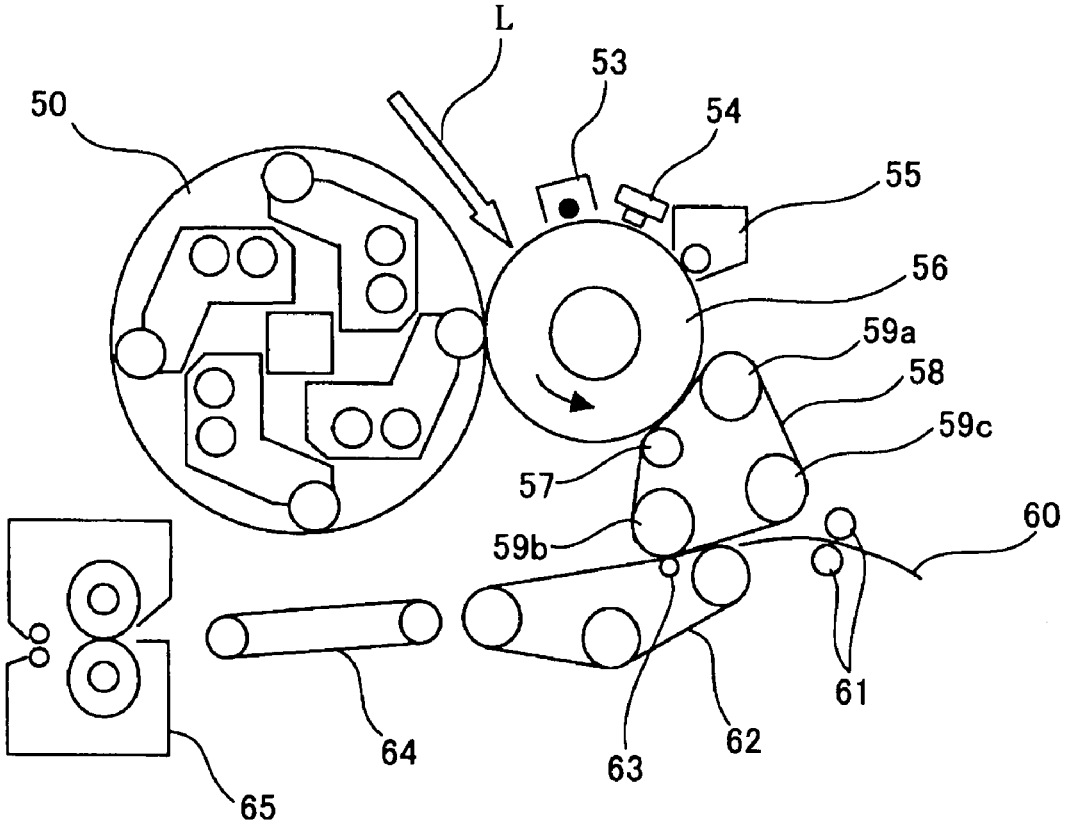
FIG. 5 is a schematic cross-sectional view of the configuration of an electrophotographic apparatus according to a third embodiment of the present invention.

FIG. 5 schematically illustrates the configuration of an electrophotographic apparatus according to a third embodiment of the present invention. In FIG. 5, while a drum-shaped photoconductor 56 (photoconductor drum), serving as a latent image bearing member, is being rotated counterclockwise, the surface of the photoconductor is uniformly charged with a charger 53 using a corotron or a scorotron (serving as a charging unit). After that, the charged surface is scanned by laser light L emitted from an unillustrated laser device (serving as an imagewise exposing unit) so as to have a latent electrostatic image. This scanning is performed on the basis of monochromatic image information; i.e., yellow, magenta, cyan or black image information of a full color image. As a result, a latent electrostatic image for yellow, magenta, cyan or black is formed on the photoconductor drum 56. In this figure, a revolver developing unit 50 is provided on the left-hand side of the photoconductor drum 56. This revolver developing unit has a rotatable drum-shaped casing and has, in the casing, yellow, magenta, cyan and black developing devices each serving as a developing unit. This revolver developing unit rotates to move the developing devices sequentially to a developing position facing the photoconductor drum 56. Notably, the yellow, magenta, cyan and black developing devices deposit yellow, magenta, cyan and black toners onto latent electrostatic images for developing. That is, latent electrostatic images for yellow, magenta, cyan and black are sequentially formed on the photoconductor drum 56, and then are sequentially developed with the corresponding developing devices of the revolver developing unit 50, to thereby form yellow, magenta, cyan and black toner images.

An intermediate transfer unit is provided downstream of the developing position in the direction in which the photoconductor drum 56 is rotated. This intermediate transfer unit includes an intermediate transfer belt 58 which is stretched by a stretching roller 59*a*, an intermediate transfer bias roller 57 (serving as a transfer unit), a secondarily transfer backup roller 59*b* and a belt driving roller 59*c*. The intermediate transfer belt is moved counterclockwise in an endless manner in this figure, while the belt driving roller 59*c* is being rotated. The yellow, magenta, cyan and black toner images developed on the photoconductor drum 56 are sequentially moved to an intermediate transfer nip where the photoconductor drum 56 is in contact with the intermediate transfer belt 58. Then, these four toner images are primarily transferred onto the intermediate transfer belt 58 in a superposed manner while receiving bias from the intermediate transfer bias roller 57, to thereby form a toner image formed of the four toner images.

Post-transfer residual toner on the surface of the photoconductor drum 56, having passed through the intermediate transfer nip in accordance with rotation, is removed with a drum cleaning unit 55 serving as a cleaning unit. The drum cleaning unit 55 removes post-transfer residual toner with a cleaning roller to which a cleaning bias is applied. The drum cleaning unit may use, for example, a cleaning brush (e.g., a fur brush or magfur brush) or a cleaning blade.

The surface of the photoconductor drum 56, whose post-transfer residual toner has been removed, is charge-eliminated with a charge-eliminating lamp 54 serving as a charge-eliminating unit. The charge-eliminating lamp 54 is a fluorescent lamp, a tungsten lamp, a halogen lamp, a mercury lamp, a sodium lamp, a light-emitting diode (LED), a laser diode (LD) or an electroluminescence (EL) lamp. The light source of the above laser device is a laser diode. Also, a filter may be used for applying light having a desired wavelength. The filter may be, for example, a sharp-cut filter, a band-pass filter, a near-infrared cut filter, a dichroic filter, an interference filter or a color conversion filter.

A pair of registration rollers 61 hold therebetween a recording paper 60 (recording medium) fed from an unillustrated paper-feeding cassette and feed the recording paper 60 toward a secondarily transfer nip, where the intermediate transfer belt 58 is in contact with a transfer belt 62, when the composite toner image on the intermediate transfer belt 58 is transferred onto the recording paper. The composite tone image on the intermediate transfer belt 58 is secondarily transferred onto the recording paper 60 at one time in the secondarily transfer nip, while receiving secondarily transfer bias from a paper transfer bias roller 63 serving as a secondarily transfer unit. As a result of the secondary transfer, a full color image is formed on the recording paper 60. The recording paper 60, onto which the full color image has been formed, is transferred to a conveyance belt 64 by a transfer belt 62. The conveyance belt 64 feeds, into a fixing unit 65, the recording paper 60 transferred from the transfer unit. The fixing unit 65 conveys the thus-fed recording paper 60 with being held at a fixing nip formed between a heating roller and a backup roller. The full color image on the recording paper 60 is fixed while being heated with the heating roller and pressurized in the fixing nip therebetween.

Notably, an unillustrated bias is applied to the transfer belt 62 and the conveyance belt 64 so as to adsorb the recording paper 60. In addition, there are provided a paper-charge-eliminating charger for charge-eliminating the recording paper 60, and three belt-charge-eliminating chargers for charge-eliminating each belt (i.e., the intermediate transfer belt 58, the transfer belt 62 and the conveyance belt 64). Furthermore, the intermediate transfer unit has a belt cleaning unit having the same configuration as the drum cleaning unit 55 so as to remove post-transfer residual toner on the intermediate transfer belt 58.

Figure 6:
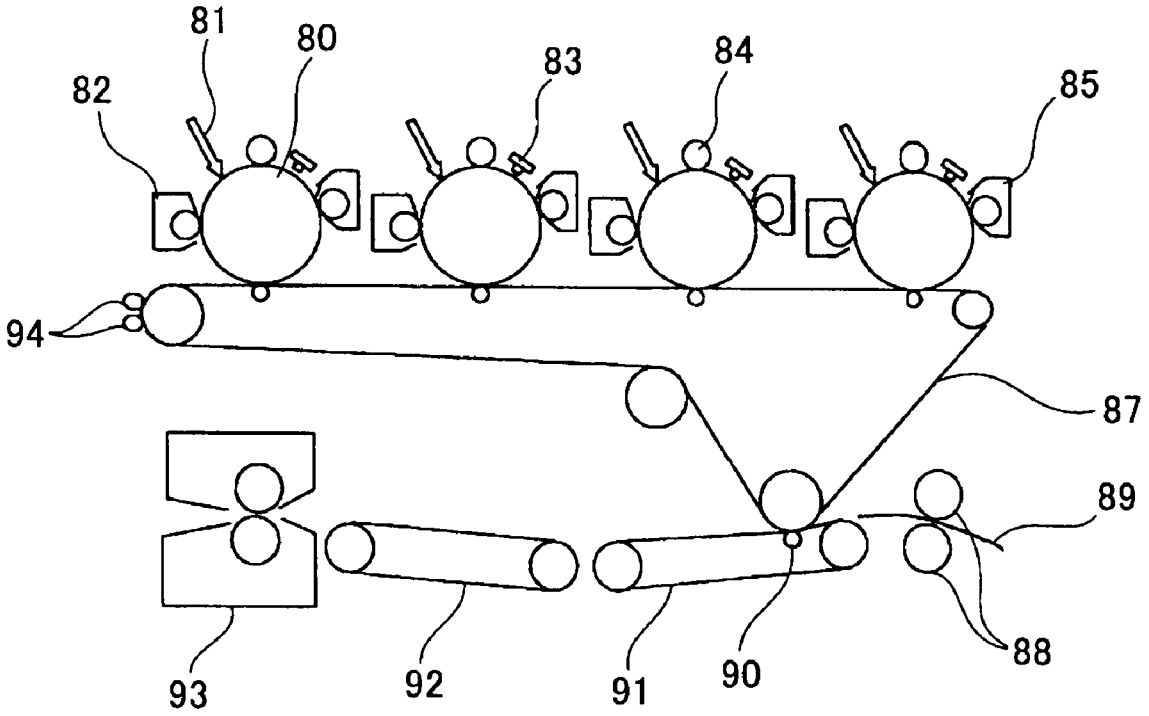
FIG. 6 is a schematic cross-sectional view of the configuration of an electrophotographic apparatus according to a fourth embodiment of the present invention.

FIG. 6 schematically illustrates the configuration of an electrophotographic apparatus according to a fourth embodiment of the present invention. This electrophotographic apparatus is a tandem-type electrophotographic apparatus having an intermediate transfer belt 87, and has photoconductor drums 80Y, 80M, 80C and 80Bk for each color (i.e., does not has a common photoconductor drum 80 for each color). The electrophotographic apparatus also has developing means (developing units) 82 for each color, drum cleaning means (cleaning units) 85 for each color, charge-eliminating lamps (change-eliminating units) 83 for each color, charging rollers (charging units) 84 for uniformly charging the drums for each color, and bias rollers (secondarily transfer units) 86 for each color. Notably, the printer illustrated in FIG. 5 has the charger 53 as a unit configured to uniformly charge a drum. But, this apparatus has charging rollers 84 as units configured to uniformly charge drums, and also has fur brushes 94 as belt-cleaning units configured to clean the intermediate transfer belt 87.

In addition, this apparatus has a pair of registration rollers 88, paper 89 serving as a recording medium, a paper-transfer bias roller 90 serving as a secondarily transfer unit, a transfer belt 91, a conveyance belt 92 and a fixing unit 93. These members are not referred to here in detail, since they are previously described above in relation to the third embodiment.

The tandem-type electrophotographic apparatus can perform, at the same time, latent electrostatic image formation (an imagewise exposing step) and developing for each color, and thus, realizes higher-speed image forming processing as compared with the revolver-type electrophotographic apparatus.

[Process Cartridge]

The above-described image forming apparatus may be fixed in copiers, facsimiles and printers, or may be mounted thereto in the form of a process cartridge. Here, the process cartridge is a single device (part) including a photoconductor 21 and at least one selected from a charging unit, an imagewise exposing unit, a developing unit, a transfer unit, a cleaning unit and a charge-eliminating unit.

Figure 7:
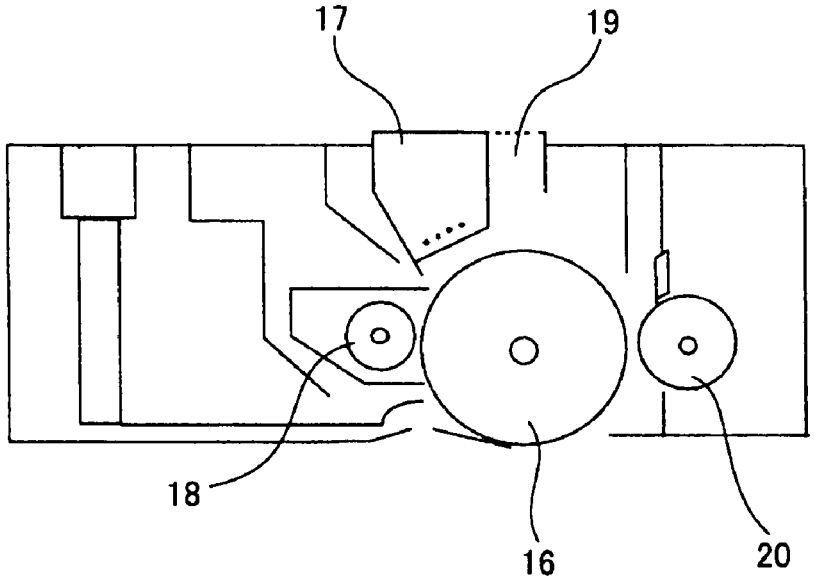
FIG. 7 is a schematic cross-sectional view of the configuration of a process cartridge according to an embodiment of the present invention.

The process cartridge may have various shapes. FIG. 7 illustrates one common process cartridge.

FIG. 7 schematically illustrates a process cartridge according to an embodiment of the present invention.

The process cartridge according to this embodiment has an electrophotographic photoconductor 16, a charger 17 serving as a charging unit, an imagewise exposing portion 19 serving as an imagewise exposing unit, a developing roller 20 serving as a developing unit, and a cleaning brush 18 serving as a cleaning unit.

EXAMPLES

Example A-1

An alkyl resin (BECKOLITE M-6401-50, product of Dainippon Ink and Chemicals, Inc.) and an amino resin (SUPER BECKAMINE G-821-60, product of Dainippon Ink and Chemicals, Inc.) were mixed with each other at a ratio by mass of 65:35. The resultant resin mixture and titanium oxide (CR-EL, product of ISHIHARA SANGYO KAISHA, LTD.) in a ratio of 1:3 were dissolved in methyl ethyl ketone to prepare a coating liquid. The thus-prepared coating liquid was applied onto a cylindrical aluminum drum (conductive substrate) having undergone no surface lathing (diameter: 24 mm) so as to have a thickness of 1.5 μm, to thereby form an underlayer.

Figure 8:
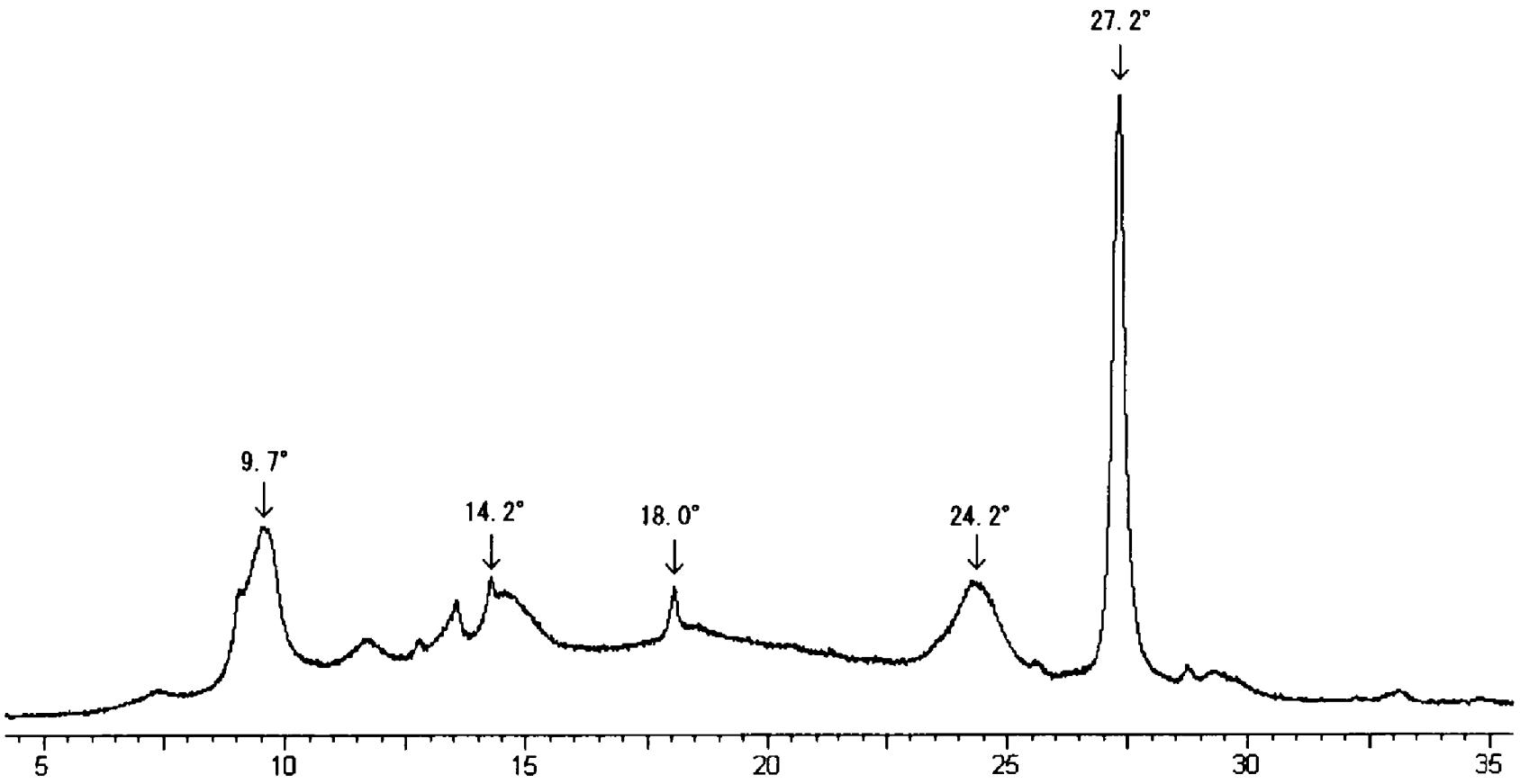
FIG. 8 is an X-ray diffraction spectrum of oxytitanium phthalocyanine used in Examples.

Next, a polyvinyl butyral resin (BX-1, product of SEKISUI CHEMICAL CO., LTD.) (10 g) was dissolved in 1,3-dioxolane (500 mL). Thereafter, oxytitanium phthalocyanine powder (15 g) with a maximum peak at an angle of 27.3° (2θ±0.2° in a Cukα X-ray diffraction spectrum (FIG. 8) and glass beads were added to the above-prepared solution, followed by dispersing for 20 hours with a sand mill disperser. The thus-obtained dispersion liquid was filtrated for removing the glass beads to prepare a coating liquid for forming a charge generation layer. This coating liquid was applied onto the above-formed underlayer through dip coating, followed by drying, to thereby form a charge generation layer with a thickness of 0.2 μm.

Subsequently, a polycarbonate resin (binder resin, PCZ-500 (product of MITSUBISHI GAS CHEMICAL COMPANY, INC.)), a compound having Chemical Formula (A-Ia) (charge transport agent), the amine compound represented by General Formula (IIa) and a compound having the following Chemical Formula (A) (UV ray absorber) in a proportion by mass of 1:1:0.1:0.1 were dissolved in tetrahydrofuran to prepare a coating liquid for forming a charge transport layer. The substrate on which the charge generation layer had been formed was dipped in the thus-prepared coating liquid, followed by drying at 130° C. for 60 min, to thereby form a charge transport layer with a thickness of 25.0 μm. Through the above procedure, an electrophotographic photoconductor was produced.

Chemical Formula (A)

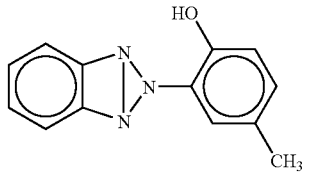

Example A-2

The procedure of Example A-1 was repeated, except that the binder resin, the charge transport agent having Chemical Formula (A-Ia), the amine compound having Chemical Formula (IIa) and the compound having Chemical Formula (A) were used in a proportion by mass of 1:1:0.01:0.1, to thereby produce an electrophotographic photoconductor.

Example A-3

The procedure of Example A-1 was repeated, except that the binder resin, the charge transport agent having Chemical Formula (A-Ia), the amine compound having Chemical Formula (IIa) and the compound having Chemical Formula (A) were used in a proportion by mass of 1:1:0.3:0.1, to thereby produce an electrophotographic photoconductor.

Example A-4

The procedure of Example A-1 was repeated, except that the charge transport agent having Chemical Formula (A-Ia) was changed to a charge transport agent having Chemical Formula (A-Id), to thereby produce an electrophotographic photoconductor.

Example A-5

The procedure of Example A-1 was repeated, except that the charge transport agent having Chemical Formula (A-Ia) was changed to a charge transport agent having Chemical Formula (A-Ie), to thereby produce an electrophotographic photoconductor.

Example A-6

The procedure of Example A-1 was repeated, except that the charge transport agent having Chemical Formula (A-Ia) was changed to a charge transport agent having Chemical Formula (A-If), to thereby produce an electrophotographic photoconductor.

Example A-7

The procedure of Example A-1 was repeated, except that the charge transport agent having Chemical Formula (A-Ia) was changed to a charge transport agent having Chemical Formula (A-Ig), to thereby produce an electrophotographic photoconductor.

Example A-8

The procedure of Example A-1 was repeated, except that the amine compound having Chemical Formula (IIa) was changed to an amine compound having Chemical Formula (IIb), to thereby produce an electrophotographic photoconductor.

Example A-9

The procedure of Example A-1 was repeated, except that the amine compound having Chemical Formula (IIa) was changed to an amine compound having Chemical Formula (IIc), to thereby produce an electrophotographic photoconductor.

Example A-10

The procedure of Example A-1 was repeated, except that the amine compound having Chemical Formula (IIa) was changed to an amine compound having Chemical Formula (IId), to thereby produce an electrophotographic photoconductor.

Example A-11

The procedure of Example A-1 was repeated, except that the amine compound having Chemical Formula (IIa) was changed to an amine compound having Chemical Formula (IIe), to thereby produce an electrophotographic photoconductor.

Example A-12

The procedure of Example A-1 was repeated, except that the binder resin, the charge transport agent having Chemical Formula (A-Ia), the amine compound having Chemical Formula (IIa), the UV ray absorber having Chemical Formula (A) and an antioxidant having the following Chemical Formula (B) were used in a proportion by mass of 1:1:0.1:0.1:0.1, to thereby produce an electrophotographic photoconductor.

Chemical Formula (B)

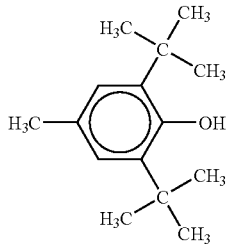

Comparative Example A-1

The procedure of Example A-1 was repeated, except that the charge transport agent having Chemical Formula (A-Ia) was changed to a charge transport agent having the following Chemical Formula (C), to thereby produce an electrophotographic photoconductor.

Chemical Formula (C)

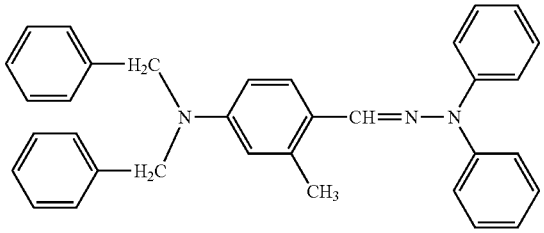

Comparative Example A-2

The procedure of Example A-1 was repeated, except that the charge transport agent having Chemical Formula (A-Ia) was changed to a charge transport agent having the following Chemical Formula (D), to thereby produce an electrophotographic photoconductor.

Chemical Formula (D)

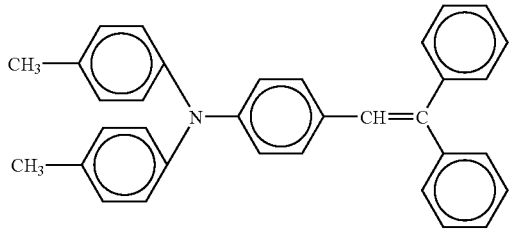

Comparative Example A-3

The procedure of Example A-1 was repeated, except that the amine compound having Chemical Formula (IIa) was not contained in the charge transport layer, to thereby produce an electrophotographic photoconductor.

Comparative Example A-4

The procedure of Example A-1 was repeated, except that the amine compound having Chemical Formula (IIa) was changed to an antioxidant having Chemical Formula (B), to thereby produce an electrophotographic photoconductor.

Comparative Example A-5

The procedure of Example A-1 was repeated, except that, in the charge transport layer-coating liquid, an antioxidant having the following Chemical Formula (E) was used instead of the amine compound having Chemical Formula (IIa) and the UV ray absorber having Chemical Formula (A) was omitted therein; and that the binder resin, the charge transport agent having Chemical Formula (A-Ia) and the antioxidant having Chemical Formula (E) were used in a proportion by mass of 1:1:0.1, to thereby produce an electrophotographic photoconductor.

Chemical Formula (E)

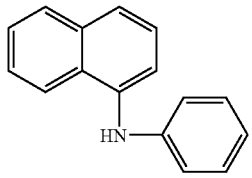

Comparative Example A-6

The procedure of Example A-1 was repeated, except that, in the charge transport layer-coating liquid, an antioxidant having the following Chemical Formula (F) was used instead of the amine compound having Chemical Formula (IIa) and the UV ray absorber having Chemical Formula (A) was omitted therein; and that the binder resin, the charge transport agent having Chemical Formula (A-Ia) and an antioxidant having Chemical Formula (F) were used in a proportion by mass of 1:1:0.1, to thereby produce an electrophotographic photoconductor.

Chemical Formula (F)

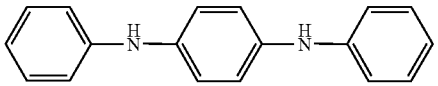

Comparative Example A-7

The procedure of Example A-1 was repeated, except that, in the charge transport layer-coating liquid, an antioxidant having the following Chemical Formula (G) was used instead of the amine compound having Chemical Formula (IIa) and the UV ray absorber having Chemical Formula (A) was omitted therein; and that the binder resin, the charge transport agent having Chemical Formula (A-Ia) and the antioxidant having Chemical Formula (G) were used in a proportion by mass of 1:1:0.1, to thereby produce an electrophotographic photoconductor.

Chemical Formula (G)

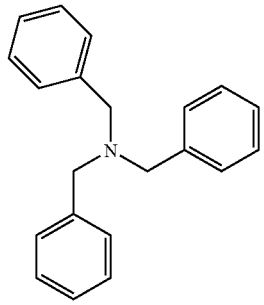

Example B-1

An alkyl resin (BECKOLITE M-6401-50, product of Dainippon Ink and Chemicals, Inc.) and an amino resin (SUPER BECKAMINE G-821-60, product of Dainippon Ink and Chemicals, Inc.) were mixed with each other at a ratio by mass of 65:35. The resultant resin mixture and titanium oxide (CR-EL, product of ISHIHARA SANGYO KAISHA, LTD.) in a ratio of 1:3 were dissolved in methyl ethyl ketone to prepare a coating liquid. The thus-prepared coating liquid was applied onto a cylindrical aluminum drum (conductive substrate) having undergone no surface lathing (diameter: 24 mm) so as to have a thickness of 1.5 μm, to thereby form an underlayer.

Next, a polyvinyl butyral resin (BX-1, product of SEKISUI CHEMICAL CO., LTD.) (10 g) was dissolved in 1,3-dioxolane (500 mL). Thereafter, oxytitanium phthalocyanine powder (15 g) with a maximum peak at an angle of 27.3° (2θ±0.2° in a Cukα X-ray diffraction spectrum (FIG. 8) and glass beads were added to the above-prepared solution, followed by dispersing for 20 hours with a sand mill disperser. The thus-obtained dispersion liquid was filtrated for removing the glass beads to prepare a coating liquid for forming a charge generation layer. This coating liquid was applied onto the above-formed underlayer through dip coating, followed by drying, to thereby form a charge generation layer with a thickness of 0.2 μm.

Subsequently, a polycarbonate resin (binder resin, PCZ-500 (product of MITSUBISHI GAS CHEMICAL COMPANY, INC.)), a compound having Chemical Formula (B-Ia) (charge transport agent), the amine compound represented by General Formula (IIa) and a compound having the following Chemical Formula (A) (UV ray absorber) in a proportion by mass of 1:1:0.1:0.1 were dissolved in tetrahydrofuran to prepare a coating liquid for forming a charge transport layer. The substrate on which the charge generation layer had been formed was dipped in the thus-prepared coating liquid, followed by drying at 130° C. for 60 min, to thereby form a charge transport layer with a thickness of 25.0 μm. Through the above procedure, an electrophotographic photoconductor was produced.

Chemical Formula (A)

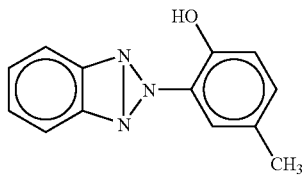

Example B-2

The procedure of Example B-1 was repeated, except that the binder resin, the charge transport agent having Chemical Formula (B-Ia), the amine compound having Chemical Formula (IIa) and the compound having Chemical Formula (A) were used in a proportion by mass of 1:1:0.01:0.1, to thereby produce an electrophotographic photoconductor.

Example B-3

The procedure of Example B-1 was repeated, except that the binder resin, the charge transport agent having Chemical Formula (B-Ia), the amine compound having Chemical Formula (IIa) and the compound having Chemical Formula (A) were used in a proportion by mass of 1:1:0.3:0.1, to thereby produce an electrophotographic photoconductor.

Example B-4

The procedure of Example B-1 was repeated, except that the charge transport agent having Chemical Formula (B-Ia) was changed to a charge transport agent having Chemical Formula (B-Ib), to thereby produce an electrophotographic photoconductor.

Example B-5

The procedure of Example B-1 was repeated, except that the charge transport agent having Chemical Formula (B-Ia) was changed to a charge transport agent having Chemical Formula (B-Ic), to thereby produce an electrophotographic photoconductor.

Example B-6

The procedure of Example B-1 was repeated, except that the charge transport agent having Chemical Formula (B-Ia) was changed to a charge transport agent having Chemical Formula (B-If), to thereby produce an electrophotographic photoconductor.

Example B-7

The procedure of Example B-1 was repeated, except that the amine compound having Chemical Formula (IIa) was changed to the amine compound having Chemical Formula (IIb), to thereby produce an electrophotographic photoconductor.

Example B-8

The procedure of Example B-1 was repeated, except that the amine compound having Chemical Formula (IIa) was changed to an amine compound having Chemical Formula (IIc), to thereby produce an electrophotographic photoconductor.

Example B-9

The procedure of Example B-1 was repeated, except that the amine compound having Chemical Formula (IIa) was changed to an amine compound having Chemical Formula (IId), to thereby produce an electrophotographic photoconductor.

Example B-10

The procedure of Example B-1 was repeated, except that the amine compound having Chemical Formula (IIa) was changed to an amine compound having Chemical Formula (IIe), to thereby produce an electrophotographic photoconductor.

Example B-11

The procedure of Example B-1 was repeated, except that the binder resin, the charge transport agent having Chemical Formula (B-Ia), the amine compound having Chemical Formula (IIa), the UV ray absorber having Chemical Formula (A) and an antioxidant having the following Chemical Formula (B) were used in a proportion by mass of 1:1:0.1:0.1:0.1, to thereby produce an electrophotographic photoconductor.

Chemical Formula (B)

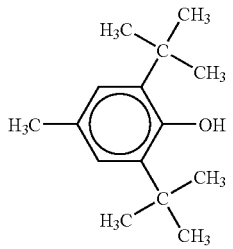

Comparative Example B-1

The procedure of Example B-1 was repeated, except that the charge transport agent having Chemical Formula (B-Ia) was changed to a charge transport agent having the following Chemical Formula (C), to thereby produce an electrophotographic photoconductor.

Chemical Formula (C)

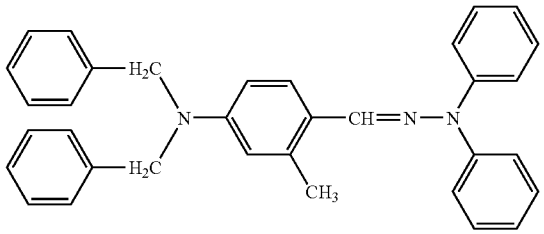

Comparative Example B-2

The procedure of Example B-1 was repeated, except that the charge transport agent having Chemical Formula (B-Ia) was changed to a charge transport agent having the following Chemical Formula (D), to thereby produce an electrophotographic photoconductor.

Chemical Formula (D)

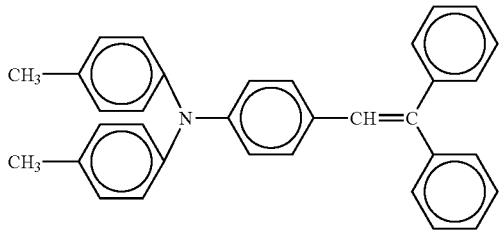

Comparative Example B-3

The procedure of Example B-1 was repeated, except that the amine compound having Chemical Formula (B-IIa) was not contained in the charge transport layer, to thereby produce an electrophotographic photoconductor.

Comparative Example B-4

The procedure of Example B-1 was repeated, except that the amine compound having Chemical Formula (B-IIa) was changed to an antioxidant having Chemical Formula (B), to thereby produce an electrophotographic photoconductor.

Comparative Example B-5

The procedure of Example B-1 was repeated, except that, in the charge transport layer-coating liquid, the amine compound having Chemical Formula (B-IIa) was changed to an antioxidant having the following Chemical Formula (E) and the UV ray absorber having Chemical Formula (A) was omitted therein; and that the binder resin, the charge transport agent having Chemical Formula (B-Ia), the antioxidant having Chemical Formula (E) were used in a proportion by mass of 1:1:0.1, to thereby produce an electrophotographic photoconductor.

Chemical Formula (E)

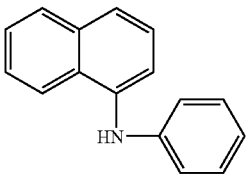

Comparative Example B-6

The procedure of Example B-1 was repeated, except that, in the charge transport layer-coating liquid, the amine compound having Chemical Formula (B-IIa) was changed to an antioxidant having the following Chemical Formula (F) and the UV ray absorber having Chemical Formula (A) was omitted therein; and that the binder resin, the charge transport agent having Chemical Formula (B-Ia) and the antioxidant having the following Chemical Formula (F) were used in a proportion by mass of 1:1:0.1, to thereby produce an electrophotographic photoconductor.

Chemical Formula (F)

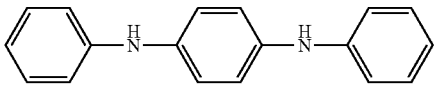

Comparative Example B-7

The procedure of Example B-1 was repeated, except that, in the charge transport layer-coating liquid, the amine compound having Chemical Formula (IIa) was changed to an antioxidant having the following Chemical Formula (G) and the UV ray absorber having Chemical Formula (A) was omitted therein; and that the binder resin, the charge transport agent having Chemical Formula (B-Ia), the antioxidant having Chemical Formula (G) were used in a proportion by mass of 1:1:0.1, to thereby produce an electrophotographic photoconductor.

Chemical Formula (G)

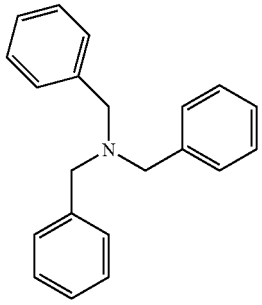

Example C-1

An alkyl resin (BECKOLITE M-6401-50, product of Dainippon Ink and Chemicals, Inc.) and an amino resin (SUPER BECKAMINE G-821-60, product of Dainippon Ink and Chemicals, Inc.) were mixed with each other at a ratio by mass of 65:35. The resultant resin mixture and titanium oxide (CR-EL, product of ISHIHARA SANGYO KAISHA, LTD.) in a ratio of 1:3 were dissolved in methyl ethyl ketone to prepare a coating liquid. The thus-prepared coating liquid was applied onto a cylindrical aluminum drum (conductive substrate) having undergone no surface lathing (diameter: 24 mm) so as to have a thickness of 1.5 μm, to thereby form an underlayer.

Next, a polyvinyl butyral resin (BX-1, product of SEKISUI CHEMICAL CO., LTD.) (10 g) was dissolved in 1,3-dioxolane (500 mL). Thereafter, oxytitanium phthalocyanine powder (10 g) with a maximum peak at an angle of 27.3° (2θ±0.2° in a Cukα X-ray diffraction spectrum (FIG. 8) and glass beads were added to the above-prepared solution, followed by dispersing for 20 hours with a sand mill disperser. The thus-obtained dispersion liquid was filtrated for removing the glass beads to prepare a coating liquid for forming a charge generation layer. This coating liquid was applied onto the above-formed underlayer through dip coating, followed by drying, to thereby form a charge generation layer with a thickness of 0.2 μm.

Subsequently, a polycarbonate resin (binder resin, Z-400 (product of MITSUBISHI GAS CHEMICAL COMPANY, INC.)), a compound having Chemical Formula (C-Ia) (charge transport agent), an amine compound having Chemical Formula (IIa) and a compound having the following Chemical Formula (A) (UV ray absorber) in a proportion by mass of 1.0:1.0:0.1:0.1 were dissolved in tetrahydrofuran to prepare a coating liquid for forming a charge transport layer. The substrate on which the charge generation layer had been formed was dipped in the thus-prepared coating liquid, followed by drying at 130° C. for 60 min, to thereby form a charge transport layer with a thickness of 25.0 μm. Through the above procedure, an electrophotographic photoconductor was produced.

Chemical Formula (A)

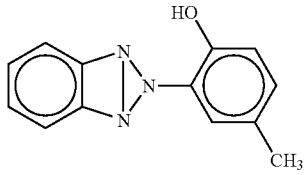

Example C-2

The procedure of Example C-1 was repeated, except that the charge transport agent having Chemical Formula (C-Ia) was changed to a charge transport agent having Chemical Formula (C-Ib), to thereby produce an electrophotographic photoconductor.

Example C-3

The procedure of Example C-1 was repeated, except that the charge transport agent having Chemical Formula (C-Ia) was changed to a charge transport agent having Chemical Formula (C-Ic), to thereby produce an electrophotographic photoconductor.

Example C-4

The procedure of Example C-1 was repeated, except that the charge transport agent having Chemical Formula (C-Ia) was changed to a charge transport agent having Chemical Formula (C-Id), to thereby produce an electrophotographic photoconductor.

Example C-5

The procedure of Example C-1 was repeated, except that the charge transport agent having Chemical Formula (C-Ia) was changed to a charge transport agent having Chemical Formula (C-Ie), to thereby produce an electrophotographic photoconductor.

Example C-6

The procedure of Example C-1 was repeated, except that the charge transport agent having Chemical Formula (C-Ia) was changed to a charge transport agent having Chemical Formula (C-If), to thereby produce an electrophotographic photoconductor.

Example C-7

The procedure of Example C-1 was repeated, except that the charge transport agent having Chemical Formula (C-Ia) was changed to a charge transport agent having Chemical Formula (C-Ig), to thereby produce an electrophotographic photoconductor.

Example C-8

The procedure of Example C-1 was repeated, except that, in the charge transport layer-coating liquid, the binder resin, the charge transport agent having Chemical Formula (C-Ia), the amine compound having Chemical Formula (IIa) and the UV ray absorber having Chemical Formula (A) were used in a proportion by mass of 1.0:1.0:0.01:0.1, to thereby produce an electrophotographic photoconductor.

Example C-9

The procedure of Example C-1 was repeated, except that, in the charge transport layer-coating liquid, the binder resin, the charge transport agent having Chemical Formula (C-Ia), the amine compound having Chemical Formula (IIa) and the UV ray absorber having Chemical Formula (A) were used in a proportion by mass of 1.0:1.0:0.3:0.1, to thereby produce an electrophotographic photoconductor.

Example C-10

The procedure of Example C-1 was repeated, except that the amine compound having Chemical Formula (IIa) was changed to an amine compound having Chemical Formula (IIb), to thereby produce an electrophotographic photoconductor.

Example C-11

The procedure of Example C-1 was repeated, except that the amine compound having Chemical Formula (IIa) was changed to an amine compound having Chemical Formula (IIc), to thereby produce an electrophotographic photoconductor.

Example C-12

The procedure of Example C-1 was repeated, except that the amine compound having Chemical Formula (IIa) was changed to an amine compound having Chemical Formula (IId), to thereby produce an electrophotographic photoconductor.

Example C-13

The procedure of Example C-1 was repeated, except that the amine compound having Chemical Formula (IIa) was changed to an amine compound having Chemical Formula (IIe), to thereby produce an electrophotographic photoconductor.

Example C-14

The procedure of Example C-1 was repeated, except that an antioxidant having the following Chemical Formula (B) was further added to the charge transport layer-coating liquid and that, in the charge transport layer-coating liquid, the binder resin, the charge transport agent having Chemical Formula (C-Ia), the amine compound having Chemical Formula (C-IIa), the UV ray absorber having Chemical Formula (A) and the antioxidant having Chemical Formula (B) were used in a proportion by mass of 1.0:1.0:0.1:0.1:0.1, to thereby produce an electrophotographic photoconductor.

Chemical Formula (B)

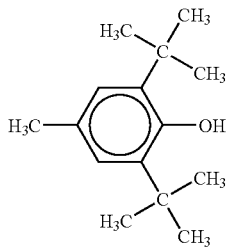

Example C-15

The procedure of Example C-1 was repeated, except that the antioxidant having Chemical Formula (A) was not contained in the charge transport layer-coating liquid, to thereby produce an electrophotographic photoconductor.

Comparative Example C-1

The procedure of Example C-1 was repeated, except that the charge transport agent having Chemical Formula (C-Ia) was changed to a charge transport agent having the following Chemical Formula (C), to thereby produce an electrophotographic photoconductor.

Chemical Formula (C)

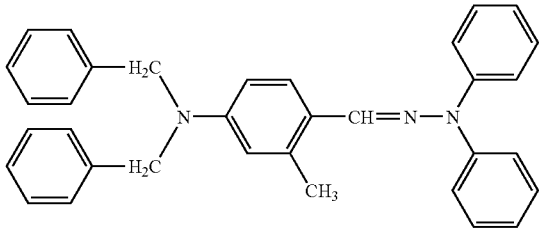

Comparative Example C-2

The procedure of Example C-1 was repeated, except that the charge transport agent having Chemical Formula (C-Ia) was changed to a charge transport agent having the following Chemical Formula (D), to thereby produce an electrophotographic photoconductor.

Chemical Formula (D)

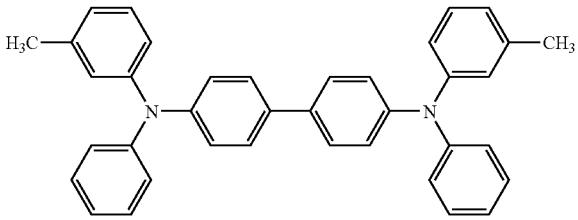

Comparative Example C-3

The procedure of Example C-1 was repeated, except that the amine compound having Chemical Formula (IIa) was not contained in the charge transport layer, to thereby produce an electrophotographic photoconductor.

Comparative Example C-4

The procedure of Example C-1 was repeated, except that the amine compound having Chemical Formula (IIa) was changed to an amine compound having Chemical Formula (B), to thereby produce an electrophotographic photoconductor.

Comparative Example C-5

The procedure of Example C-1 was repeated, except that the amine compound having Chemical Formula (IIa) was changed to an amine-based antioxidant having the following Chemical Formula (E), to thereby produce an electrophotographic photoconductor.

Chemical Formula (E)

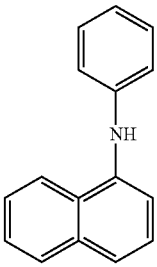

Comparative Example C-6

The procedure of Example C-1 was repeated, except that the amine compound having Chemical Formula (IIa) was changed to an amine-based antioxidant having the following Chemical Formula (F), to thereby produce an electrophotographic photoconductor.

Chemical Formula (F)

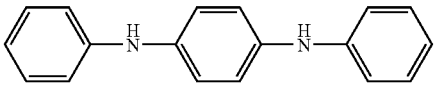

Comparative Example C-7

The procedure of Example C-1 was repeated, except that the amine compound having Chemical Formula (IIa) was changed to an amine-based antioxidant having the following Chemical Formula (G), to thereby produce an electrophotographic photoconductor.

Chemical Formula (G)

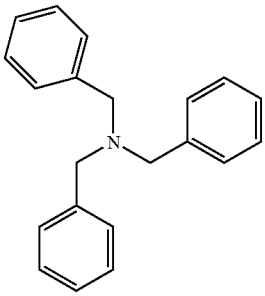

(Evaluation for Photoconductor)

<Evaluation of Electrical Characteristics Using Simplified Measuring Device>

The electrophotographic photoconductors produced in Examples A-1 to A-12, B-1 to B-11 and C-1 to C-15 and Comparative Examples A-1 to A-7, B-1 to B-7 and C-1 to C-7 were each evaluated for electrophotographic characteristics with a photoconductor drum evaluation device (dynamic mode) as described below.

The evaluation was carried out with an electrophotographic photoconductor evaluation device (product of Yamanashi Electronics Co., Ltd.). Specifically, the electrophotographic photoconductors produced in Examples and Comparative Examples were each charged so as to have a surface potential of about −700 V with a scorotron at a temperature/humidity of 23° C./50% (the charged potential at this time was regarded as (V0)). The charged photoconductor was irradiated with light having a wavelength of 650 nm using a laser diode at an exposure dose of 0.13 μJ to 0.15 μJ so that the surface potential thereof was adjusted to about −350V (about ½) (the surface potential was regarded as (VH)). Note that the residual potential after light exposure at an exposure dose of 0.6 μJ/cm$^2$ was regarded as the residual potential (VL) of each photoconductor.

Using an ozone exposure test apparatus (product of Dylec, Corp.), the above-treated electrophotographic photoconductor was exposed for 5 days to an atmosphere in which the ozone concentration was set to 5 ppm. Before and after ozone exposure, the electrophotographic photoconductor was measured for surface potential (VO), sensitivity potential (VH) and residual potential (VL). The charge-eliminating was performed using a LED lamp (20 μW) (wavelength: 660 nm). The electrophotographic photoconductor (drum) was rotated at 150 rpm. The potential of the electrophotographic photoconductor was measured 0.06 sec after laser light exposure (i.e., the time required that the photoconductor be moved from the exposing position to the measuring position). The results are shown in Tables A-1, B-1 and C-1.

Similarly, using a NOx exposure test apparatus (product of Dylec, Corp.), the electrophotographic photoconductor was exposed for 4 days to an atmosphere in which the NO and $NO_2$ concentrations were set to 40 ppm and 10 ppm, respectively. Before and after NOx exposure, the electrophotographic photoconductor was measured for surface potential (VO), sensitivity potential (VH) and residual potential (VL). The charge-elimination was performed using a LED lamp (20 μW) (wavelength: 660 nm). The electrophotographic photoconductor (drum) was rotated at 150 rpm. The potential of the electrophotographic photoconductor was measured 0.06 sec after laser light exposure (i.e., the time required that the photoconductor be moved from the exposing position to the measuring position). The results are shown in Tables A-1, B-1 and C-1.

TABLE A-1

| | Surface potential V0 (−V) | | | Sensitivity potential VH (−V) | | | Residual potential VL (−V) | | |
|---|---|---|---|---|---|---|---|---|---|
| | Initial | Ozone | NOx | Initial | Ozone | NOx | Initial | Ozone | NOx |
| Ex. A-1 | 700 | 685 | 683 | 345 | 339 | 340 | 47 | 46 | 46 |
| Ex. A-2 | 700 | 682 | 683 | 350 | 342 | 340 | 46 | 47 | 47 |
| Ex. A-3 | 700 | 680 | 682 | 348 | 338 | 339 | 45 | 46 | 46 |
| Ex. A-4 | 700 | 682 | 683 | 345 | 342 | 342 | 47 | 46 | 46 |
| Ex. A-5 | 700 | 686 | 685 | 342 | 343 | 342 | 46 | 46 | 46 |
| Ex. A-6 | 705 | 685 | 686 | 348 | 342 | 343 | 46 | 45 | 46 |
| Ex. A-7 | 700 | 681 | 682 | 348 | 343 | 342 | 46 | 47 | 47 |
| Ex. A-8 | 705 | 685 | 684 | 355 | 345 | 342 | 46 | 47 | 47 |
| Ex. A-9 | 700 | 685 | 686 | 348 | 342 | 341 | 46 | 46 | 46 |
| Ex. A-10 | 700 | 682 | 684 | 347 | 342 | 342 | 46 | 46 | 46 |
| Ex. A-11 | 700 | 685 | 686 | 353 | 345 | 346 | 47 | 48 | 48 |
| Ex. A-12 | 700 | 690 | 692 | 347 | 342 | 343 | 48 | 49 | 49 |
| Comp. Ex. A-1 | 710 | 695 | 690 | 400 | 405 | 400 | 160 | 170 | 170 |
| Comp. Ex. A-2 | 710 | 700 | 702 | 380 | 370 | 367 | 110 | 112 | 111 |
| Comp. Ex. A-3 | 700 | 540 | 530 | 355 | 210 | 190 | 47 | 46 | 45 |
| Comp. Ex. A-4 | 705 | 640 | 638 | 360 | 320 | 318 | 58 | 57 | 59 |
| Comp. Ex. A-5 | 710 | 640 | 635 | 365 | 310 | 305 | 68 | 69 | 70 |
| Comp. Ex. A-6 | 710 | 655 | 655 | 370 | 315 | 310 | 70 | 72 | 71 |
| Comp. Ex. A-7 | 705 | 655 | 660 | 355 | 310 | 305 | 47 | 46 | 46 |

TABLE B-1

| | Surface potential V0 (−V) | | | Sensitivity potential VH (−V) | | | Residual potential VL (−V) | | |
|---|---|---|---|---|---|---|---|---|---|
| | Initial | Ozone | NOx | Initial | Ozone | NOx | Initial | Ozone | NOx |
| Ex. B-1 | 705 | 688 | 687 | 345 | 338 | 340 | 50 | 48 | 49 |
| Ex. B-2 | 700 | 683 | 685 | 350 | 340 | 338 | 48 | 49 | 49 |
| Ex. B-3 | 700 | 695 | 693 | 346 | 342 | 342 | 57 | 56 | 56 |
| Ex. B-4 | 700 | 687 | 686 | 348 | 340 | 342 | 52 | 51 | 51 |
| Ex. B-5 | 700 | 690 | 688 | 344 | 340 | 338 | 49 | 48 | 48 |
| Ex. B-6 | 700 | 688 | 689 | 348 | 340 | 341 | 48 | 49 | 48 |
| Ex. B-7 | 700 | 693 | 692 | 347 | 342 | 342 | 51 | 52 | 52 |
| Ex. B-8 | 700 | 687 | 690 | 346 | 342 | 338 | 48 | 49 | 48 |
| Ex. B-9 | 702 | 686 | 688 | 348 | 341 | 342 | 48 | 48 | 49 |
| Ex. B-10 | 703 | 690 | 692 | 350 | 343 | 342 | 50 | 50 | 51 |
| Ex. B-11 | 705 | 692 | 693 | 350 | 342 | 343 | 52 | 52 | 51 |
| Comp. Ex. B-1 | 710 | 695 | 690 | 400 | 405 | 400 | 160 | 170 | 170 |
| Comp. Ex. B-2 | 710 | 700 | 702 | 380 | 370 | 367 | 110 | 112 | 111 |
| Comp. Ex. B-3 | 705 | 530 | 520 | 345 | 220 | 210 | 48 | 47 | 47 |
| Comp. Ex. B-4 | 700 | 645 | 640 | 360 | 315 | 310 | 62 | 64 | 64 |
| Comp. Ex. B-5 | 700 | 655 | 650 | 355 | 320 | 325 | 70 | 72 | 72 |
| Comp. Ex. B-6 | 705 | 650 | 655 | 365 | 320 | 315 | 75 | 77 | 77 |
| Comp. Ex. B-7 | 705 | 655 | 650 | 350 | 315 | 320 | 52 | 53 | 53 |

TABLE C-1

| | Surface potential V0 (−V) | | | Sensitivity potential VH (−V) | | | Residual potential VL (−V) | | |
|---|---|---|---|---|---|---|---|---|---|
| | Initial | Ozone | NOx | Initial | Ozone | NOx | Initial | Ozone | NOx |
| Ex. C-1 | 700 | 680 | 680 | 340 | 333 | 332 | 32 | 31 | 32 |
| Ex. C-2 | 700 | 680 | 681 | 340 | 339 | 338 | 32 | 32 | 31 |
| Ex. C-3 | 700 | 683 | 680 | 350 | 345 | 344 | 33 | 33 | 34 |
| Ex. C-4 | 705 | 682 | 680 | 350 | 344 | 343 | 35 | 35 | 35 |
| Ex. C-5 | 700 | 680 | 681 | 345 | 340 | 338 | 34 | 34 | 32 |
| Ex. C-6 | 700 | 685 | 682 | 340 | 333 | 332 | 35 | 35 | 35 |
| Ex. C-7 | 700 | 675 | 673 | 350 | 336 | 337 | 30 | 31 | 31 |
| Ex. C-8 | 700 | 685 | 685 | 350 | 342 | 341 | 33 | 35 | 35 |
| Ex. C-9 | 700 | 680 | 682 | 350 | 345 | 342 | 32 | 32 | 34 |
| Ex. C-10 | 700 | 683 | 682 | 350 | 342 | 343 | 34 | 34 | 34 |
| Ex. C-11 | 700 | 683 | 682 | 340 | 335 | 333 | 33 | 33 | 34 |
| Ex. C-12 | 700 | 683 | 681 | 340 | 335 | 336 | 34 | 34 | 32 |
| Ex. C-13 | 700 | 682 | 685 | 345 | 338 | 338 | 35 | 35 | 35 |
| Ex. C-14 | 700 | 685 | 685 | 345 | 339 | 338 | 37 | 36 | 36 |
| Ex. C-15 | 700 | 670 | 670 | 320 | 323 | 320 | 35 | 33 | 31 |
| Comp. Ex. C-1 | 710 | 695 | 690 | 400 | 405 | 400 | 160 | 170 | 170 |
| Comp. Ex. C-2 | 710 | 700 | 702 | 380 | 370 | 367 | 110 | 112 | 111 |
| Comp. Ex. C-3 | 700 | 480 | 470 | 350 | 150 | 140 | 28 | 29 | 28 |
| Comp. Ex. C-4 | 700 | 650 | 645 | 350 | 300 | 295 | 35 | 36 | 36 |
| Comp. Ex. C-5 | 700 | 660 | 660 | 345 | 305 | 300 | 35 | 37 | 37 |
| Comp. Ex. C-6 | 700 | 650 | 645 | 345 | 305 | 295 | 38 | 38 | 42 |
| Comp. Ex. C-7 | 700 | 655 | 650 | 345 | 315 | 318 | 30 | 31 | 31 |

In Tables A-1, B-1 and C-1, the smaller the change in the surface potential V0 from the initial value 700 (−V) after light exposure, the better the electrophotographic photoconductors are evaluated to be. Similarly, the smaller the change in the value VH from the initial value 350 (−V) after light exposure, the better the electrophotographic photoconductors are evaluated to be. Also, the electrophotographic photoconductors showing smaller VL exhibit excellent high-speed response.

<Image Evaluation with Actual Apparatus (Halftone Evaluation)>

The untreated (initial) electrophotographic photoconductors produced in Examples A-1 to A-12, B-1 to B-11 and C-1 to C-15 and Comparative Examples A-1 to A-7, B-1 to B-7 and C-1 to C-7, and the corresponding exposed electrophotographic photoconductors having undergone ozone or NOx exposure testing were each mounted onto a color laser printer (SP C220, product of Ricoh Company, Ltd.). The color laser printer was caused to output a halftone image (2 by 2) in an ambient environment (temperature: 23° C., humidity: 50%). The initial electrophotographic photoconductors were compared with the exposed electrophotographic photoconductors in terms of the difference in image density (measured with a Macbeth densitometer); i.e., ΔID (ΔID=initial ID−post-exposure ID). The results are shown in Tables A-2, B-2 and C-2.

Figure 9:
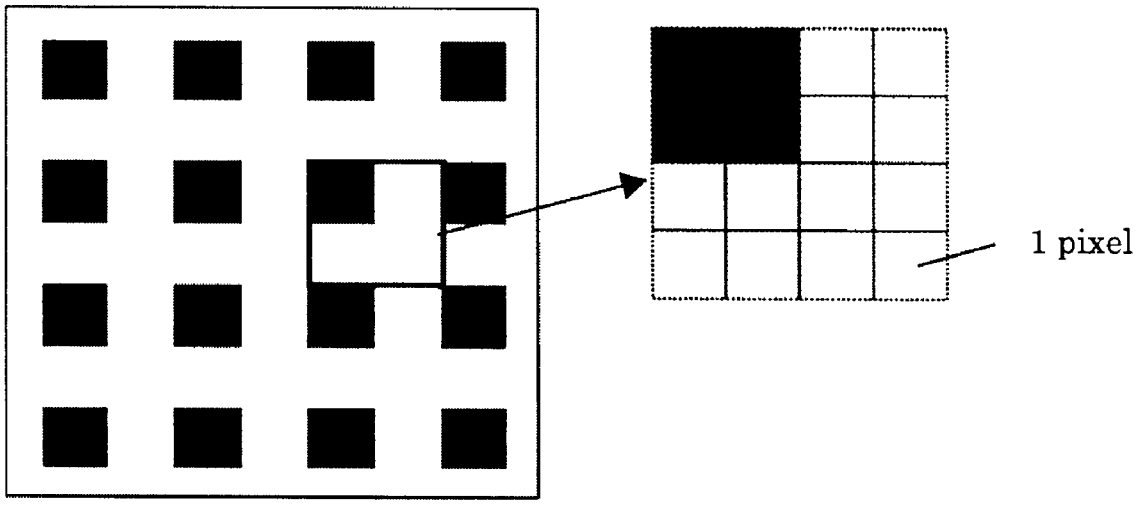
FIG. 9 is an explanatory view of a 2 by 2 print pattern adopted in Examples.

Notably, the halftone image (2 by 2) means a print pattern illustrated in FIG. 9, in which dots are formed at 2×2 pixels among 4×4 pixels.

TABLE A-2

| | ΔID without performing environmental testing | ΔID after ozone environmental testing | ΔID after NOx environmental testing |
|---|---|---|---|
| Ex. A-1 | 0 | 0.01 | 0.01 |
| Ex. A-2 | 0 | 0.02 | 0.02 |
| Ex. A-3 | 0 | 0.01 | 0.01 |
| Ex. A-4 | 0 | 0.01 | 0.01 |
| Ex. A-5 | 0 | 0.01 | 0.01 |
| Ex. A-6 | 0 | 0.01 | 0.01 |
| Ex. A-7 | 0 | 0.01 | 0.01 |

TABLE A-2-continued

| | ΔID without performing environmental testing | ΔID after ozone environmental testing | ΔID after NOx environmental testing |
|---|---|---|---|
| Ex. A-8 | 0 | 0.01 | 0.01 |
| Ex. A-9 | 0 | 0.01 | 0.01 |
| Ex. A-10 | 0 | 0.01 | 0.01 |
| Ex. A-11 | 0 | 0.01 | 0.01 |
| Ex. A-12 | 0 | 0.01 | 0.01 |
| Comp. Ex. A-1 | 0 | Could not be evaluated due to insufficient density | Could not be evaluated due to insufficient density |
| Comp. Ex. A-2 | 0 | Could not be evaluated due to insufficient density | Could not be evaluated due to insufficient density |
| Comp. Ex. A-3 | 0 | 0.11 | 0.12 |
| Comp. Ex. A-4 | 0 | 0.06 | 0.06 |
| Comp. Ex. A-5 | 0 | 0.06 | 0.06 |
| Comp. Ex. A-6 | 0 | 0.06 | 0.05 |
| Comp. Ex. A-7 | 0 | 0.05 | 0.06 |

TABLE B-2

| | ΔID without performing environmental testing | ΔID after ozone environmental testing | ΔID after NOx environmental testing |
|---|---|---|---|
| Ex. B-1 | 0 | 0.01 | 0.01 |
| Ex. B-2 | 0 | 0.02 | 0.02 |
| Ex. B-3 | 0 | 0.01 | 0.01 |
| Ex. B-4 | 0 | 0.01 | 0.01 |
| Ex. B-5 | 0 | 0.01 | 0.01 |
| Ex. B-6 | 0 | 0.01 | 0.01 |
| Ex. B-7 | 0 | 0.01 | 0.01 |

TABLE B-2-continued

| | ΔID without performing environmental testing | ΔID after ozone environmental testing | ΔID after NOx environmental testing |
|---|---|---|---|
| Ex. B-8 | 0 | 0.01 | 0.01 |
| Ex. B-9 | 0 | 0.01 | 0.01 |
| Ex. B-10 | 0 | 0.01 | 0.01 |
| Ex. B-11 | 0 | 0.01 | 0.01 |
| Comp. Ex. B-1 | 0 | Could not be evaluated due to insufficient density | Could not be evaluated due to insufficient density |
| Comp. Ex. B-2 | 0 | Could not be evaluated due to insufficient density | Could not be evaluated due to insufficient density |
| Comp. Ex. B-3 | 0 | 0.11 | 0.11 |
| Comp. Ex. B-4 | 0 | 0.06 | 0.05 |
| Comp. Ex. B-5 | 0 | 0.06 | 0.06 |
| Comp. Ex. B-6 | 0 | 0.06 | 0.06 |
| Comp. Ex. B-7 | 0 | 0.05 | 0.05 |

TABLE C-2

| | ΔID without performing environmental testing | ΔID after ozone environmental testing | ΔID after NOx environmental testing |
|---|---|---|---|
| Ex. C-1 | 0 | 0.01 | 0.01 |
| Ex. C-2 | 0 | 0.01 | 0.01 |
| Ex. C-3 | 0 | 0.01 | 0.01 |
| Ex. C-4 | 0 | 0.01 | 0.01 |
| Ex. C-5 | 0 | 0.01 | 0.01 |
| Ex. C-6 | 0 | 0.01 | 0.01 |
| Ex. C-7 | 0 | 0.02 | 0.02 |
| Ex. C-8 | 0 | 0.01 | 0.01 |
| Ex. C-9 | 0 | 0.01 | 0.01 |
| Ex. C-10 | 0 | 0.01 | 0.01 |
| Ex. C-11 | 0 | 0.01 | 0.01 |
| Ex. C-12 | 0 | 0.01 | 0.01 |
| Ex. C-13 | 0 | 0.01 | 0.01 |
| Ex. C-14 | 0 | 0.01 | 0.01 |
| Ex. C-15 | 0 | 0.01 | 0.01 |
| Comp. Ex. C-1 | 0 | Could not be evaluated due to insufficient density | Could not be evaluated due to insufficient density |
| Comp. Ex. C-2 | 0 | Could not be evaluated due to insufficient density | Could not be evaluated due to insufficient density |
| Comp. Ex. C-3 | 0 | 0.17 | 0.18 |
| Comp. Ex. C-4 | 0 | 0.07 | 0.07 |
| Comp. Ex. C-5 | 0 | 0.06 | 0.07 |
| Comp. Ex. C-6 | 0 | 0.06 | 0.06 |
| Comp. Ex. C-7 | 0 | 0.06 | 0.05 |

The electrophotographic photoconductors of Examples A-1 to A-12, each containing the charge transport agent represented by General Formula (A-I) and the amine compound represented by General Formula (II), were found to be excellent in ozone resistance, NOx resistance, surface potential, sensitivity potential, residual potential and image density. The electrophotographic photoconductor of Example A-2, containing the amine compound represented by General Formula (II) in a small amount, was found to be slightly inferior to that of Example A-1 in surface potential and sensitivity potential. But, this electrophotographic photoconductor involved small variation in image density and was thus evaluated as involving no practical problems. Furthermore, the electrophotographic photoconductor of Example A-3, containing the amine compound represented by General Formula (II) in a large amount, showed slightly high VL. But, this electrophotographic photoconductor was found to be equal in image density to that of Example A-1 and was evaluated as involving no practical problems.

The electrophotographic photoconductor of Comparative Example A-3, having the photoconductive layer containing no amine compound represented by General Formula (II), was considerably decreased in V0 and VH after ozone and NOx exposures. In addition, this electrophotographic photoconductor showed considerably large ΔID (i.e., a change in image density). The electrophotographic photoconductors of Comparative Examples A-4 to A-7, each having photoconductive layers containing different compounds, were slightly decreased in V0 and VH after ozone and NOx exposures, and showed a less change in image density than that of Comparative Example A-1. But, these electrophotographic photoconductors were evaluated as involving practical problems, and were inferior to those of Examples A-1 to A-12. The electrophotographic photoconductors of Comparative Examples A-1 and A-2, each containing a low-molecular-weight charge transport agent, showed considerably high VH and VL. Thus, these electrophotographic photoconductors could not be used for comparison with those of Examples, since the image evaluation with the above color printer could not be performed due to insufficient image density.

The electrophotographic photoconductors of Examples B-1 to B-11, each containing the charge transport agent represented by General Formula (B-I) and the amine compound represented by General Formula (II), were found to be excellent in ozone resistance, NOx resistance, surface potential, sensitivity potential, residual potential and image density. The electrophotographic photoconductor of Example B-2, containing the amine compound represented by General Formula (II) in a small amount, was found to be slightly inferior to that of Example B-1 in surface potential and sensitivity potential. But, this electrophotographic photoconductor involved small variation in image density and was evaluated as involving no practical problems. Furthermore, the electrophotographic photoconductor of Example B-3, containing the amine compound represented by General Formula (II) in a large amount, showed slightly high VL. But, this electrophotographic photoconductor was found to be equal in image density to that of Example B-1 and was evaluated as involving no practical problems.

The electrophotographic photoconductor of Comparative Example B-3, having the photoconductive layer containing no amine compound represented by General Formula (II), was considerably decreased in V0 and VH after ozone and NOx exposures. In addition, this electrophotographic photoconductor showed considerably large ΔID (i.e., a change in image density). The electrophotographic photoconductors of Comparative Examples B-4 to B-7, each having photoconductive layers containing different compounds, were slightly decreased in V0 and VH after ozone and NOx exposures, and showed a less change in image density than that of Comparative Example B-3. But, these electrophotographic photoconductors were evaluated as involving practical problems, and were inferior to those of Examples B-1 to B-11. The electrophotographic photoconductors of Comparative Examples B-1 and B-2, each containing a low-molecular-weight charge transport agent, showed considerably high VH and VL. Thus, these electrophotographic photoconductors could not be used for comparison with those of Examples, since the image evaluation with the above color printer could not be performed due to insufficient image density.

The electrophotographic photoconductors of Examples C-1 to C-15, each having the photoconductive layer containing the charge transport agent represented by General Formula (C-I) and the amine compound represented by General Formula (II), were found to be excellent in sensitivity, responsiveness, ozone resistance, NOx resistance, surface potential, sensitivity potential, residual potential and image density. The electrophotographic photoconductor of Example C-8, containing the antioxidant having Chemical Formula (IIa) in a small amount, was inferior to that of Example C-1 in surface potential and sensitivity potential, but showed practically applicable, small variation in image density. The electrophotographic photoconductor of Example C-9, containing the amine compound having Chemical Formula (IIa) in a large amount, showed slightly high VL, but the same image density as in that of Example C-1.

The electrophotographic photoconductors of Comparative Examples C-1 and C-2, each containing different charge transport agents, showed high V0 and VH, and could not exhibit high sensitivity and high response. The electrophotographic photoconductor of Comparative Example C-3, containing no amine compound represented by Chemical Formula (IIa), was considerably decreased in V0 and VH after ozone and NOx exposures. In addition, this electrophotographic photoconductor showed a considerably large ΔID (change in image density). The electrophotographic photoconductors of Comparative Examples C-4 to C-7, each having photoconductive layers containing different compounds, were slightly decreased in V0 and VH after ozone and NOx exposures, but increased in VL. In addition, these electrophotographic photoconductors showed less change in image density than that of Comparative Example C-3. But, these electrophotographic photoconductors were evaluated as involving practical problems, and were inferior to those of Examples C-1 to C-15.

As described above, the electrophotographic photoconductor of the present invention having a charge transport layer containing a charge transport agent represented by any one of General Formulas (A-I), (B-I) and (C-I) and an amine compound represented by General Formula (II) is excellent in responsiveness, ozone resistance, NOx resistance and electrical characteristics (e.g., surface, sensitivity and residual potentials).

Use of the electrophotographic photoconductor requires no replacement of an electrophotographic photoconductor, and realizes high-speed printing and downsizing of an apparatus housing the electrophotographic photoconductor. In addition, the electrophotographic photoconductor can provide an electrophotographic method, an electrophotographic apparatus and an electrophotographic process cartridge, in which high-quality images can be stably formed after repetitive use.

What is claimed is:

1. An electrophotographic photoconductor comprising:

a conductive substrate, and a photoconductive layer provided over the conductive substrate, wherein the photoconductive layer contains a charge generation agent and a charge transport agent represented by any one of the following Chemical Formulas A-Ic, A-Ie, A-If, A-Ig, A-Ih, General Formula (B-I) or General Formula (C-I), and an amine compound represented by the following General Formula (II):

Chemical Formula (A-Ic)

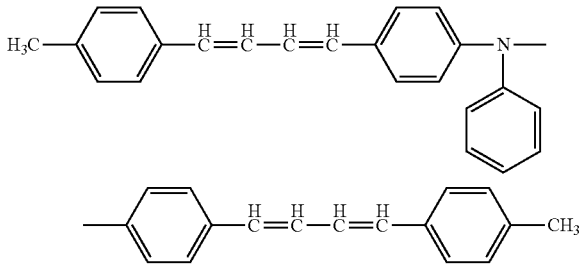

Chemical Formula (A-Ie)

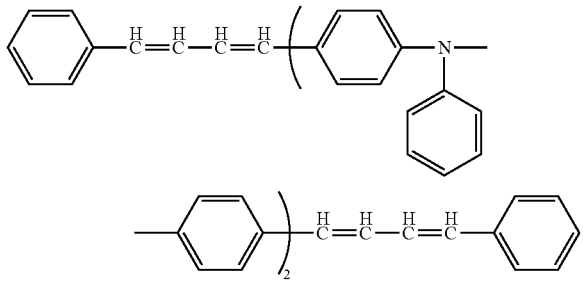

Chemical Formula (A-If)

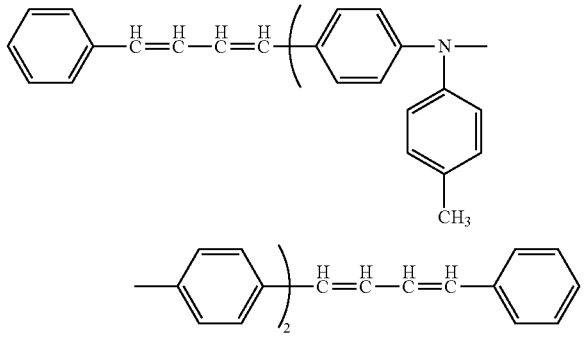

Chemical Formula (A-Ig)

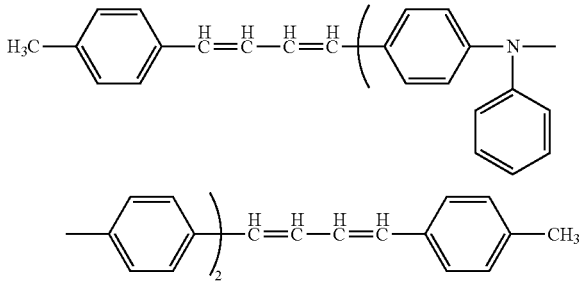

Chemical Formula (A-Ih)

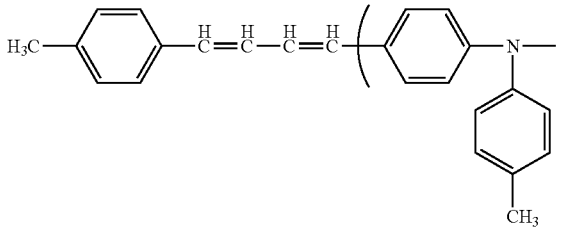

-continued

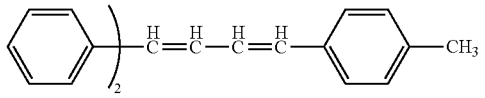

General Formula (B-I)

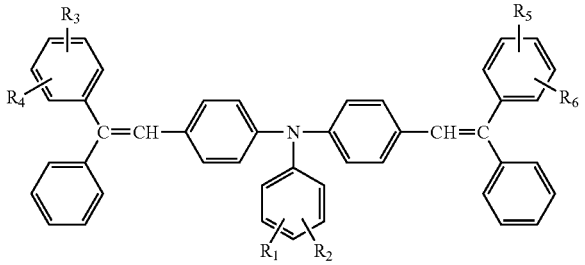

in General Formula (B-I), $R_1$ and $R_2$ each independently represent a C1 to C6 alkyl group and $R_3$ to $R_6$ each independently represent a hydrogen atom, a halogen atom or a C1 to C6 alkyl group which may have a substituent, General Formula (C-I)

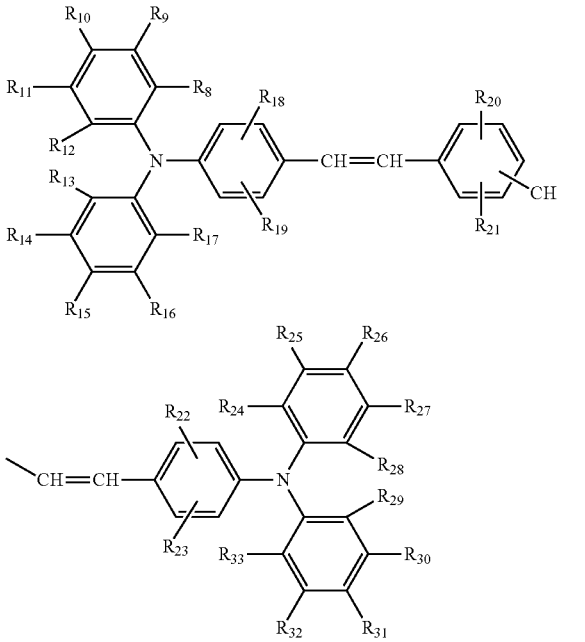

in General Formula (C-I), $R_8$ to $R_{33}$ each independently represent a hydrogen atom, a C1 to C4 alkyl group, a C1 to C4 alkoxy group, or a substituted or unsubstituted phenyl group, and may be identical or different, General Formula (II)

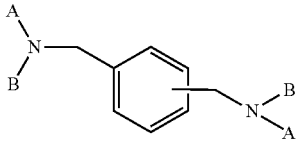

in General Formula (II), A and B each independently represent a group represented by the following formula (I) or (ii), and may be identical or different:

$—CH_2X$ formula (I)

$—CH_2CH_2Y$ formula (II)

where X and Y each independently represent an aromatic group which may have a substituent.

2. The electrophotographic photoconductor according to claim 1, wherein the photoconductive layer contains a charge generation layer and a charge transport layer, and the charge generation layer and the charge transport layer are laid over the conductive substrate in this order.

3. The electrophotographic photoconductor according to claim 2, wherein the charge generation layer contains the charge generation agent, and the charge transport layer contains the charge transport agent.

4. The electrophotographic photoconductor according to claim 1, wherein the amine compound contains a compound having the following Chemical Formula (IIa):

Chemical Formula (IIa)

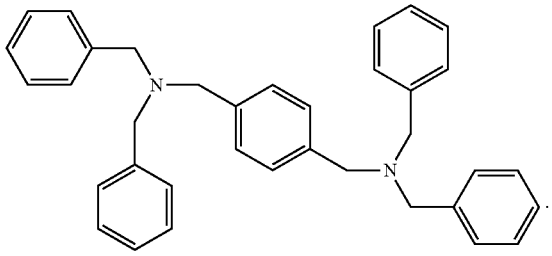

5. The electrophotographic photoconductor according to claim 1, wherein the amine compound contains a compound having the following Chemical Formula (IIb):

Chemical Formula (IIb)

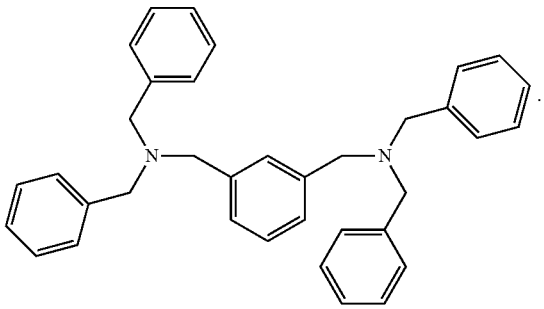

6. The electrophotographic photoconductor according to claim 1, wherein the amine compound contains a compound having the following Chemical Formula (IIc):

Chemical Formula (IIc)

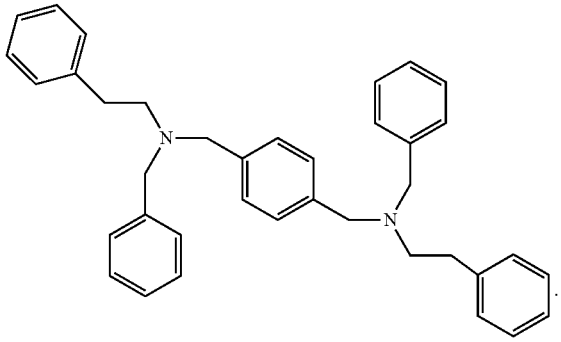

7. The electrophotographic photoconductor according to claim 1, wherein the amine compound contains a compound having the following Chemical Formula (IId):

Chemical Formula (IId)

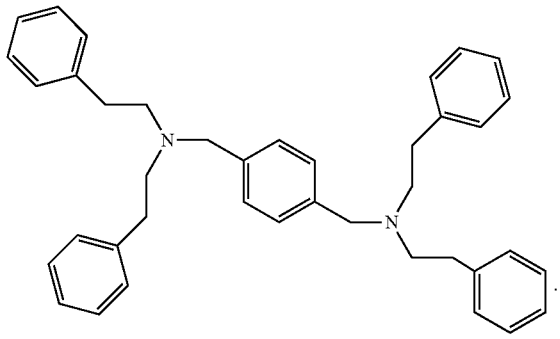

8. The electrophotographic photoconductor according to claim 1, wherein the amine compound contains a compound having the following Chemical Formula (IIe):

Chemical Formula (IIe)

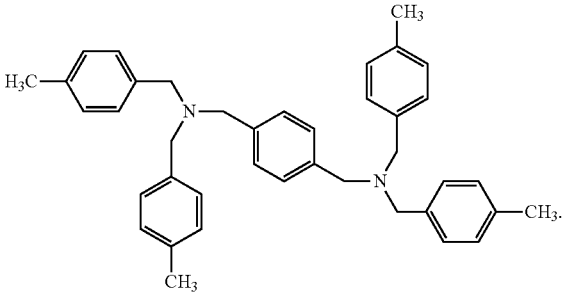

9. The electrophotographic photoconductor according to claim 2, wherein the charge transport layer contains a benzotriazole-based UV ray absorber.

10. The electrophotographic photoconductor according to claim 2, wherein the charge transport layer contains a phenol-based antioxidant.

11. An electrophotographic apparatus comprising:

an electrophotographic photoconductor, a charging unit configured to charge a surface of the electrophotographic photoconductor, an imagewise exposing unit configured to form a latent electrostatic image on the surface of the electrophotographic photoconductor, a developing unit configured to develop the latent electrostatic image to form a toner image, and a transfer unit configured to transfer the toner image directly or via an intermediate transfer member onto a recording medium, wherein the electrophotographic photoconductor comprises a conductive substrate and a photoconductive layer provided over the conductive substrate, wherein the photoconductive layer contains a charge generation agent and a charge transport agent represented by any one of the following Chemical Formulas A-Ic, A-Ie, A-If, A-Ig, A-Ih, General Formula (B-I) or General Formula (C-I), and an amine compound represented by the following General Formula (II):

Chemical Formula (A-Ic)

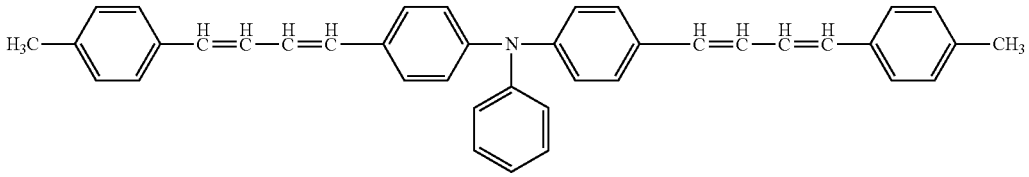

Chemical Formula (A-Ie)

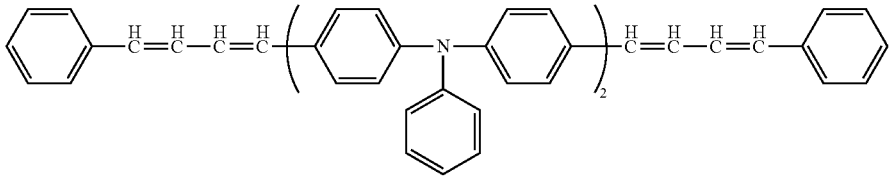

-continued
Chemical Formula (A-If)
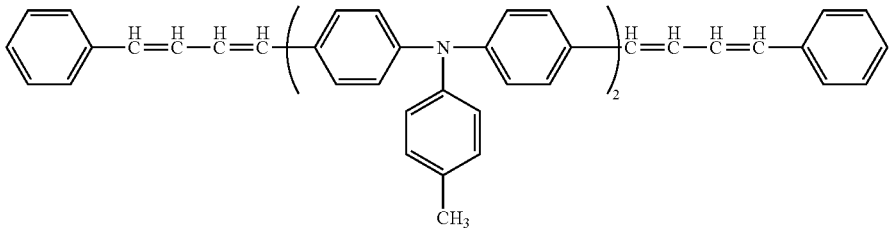
Chemical Formula (A-Ig)
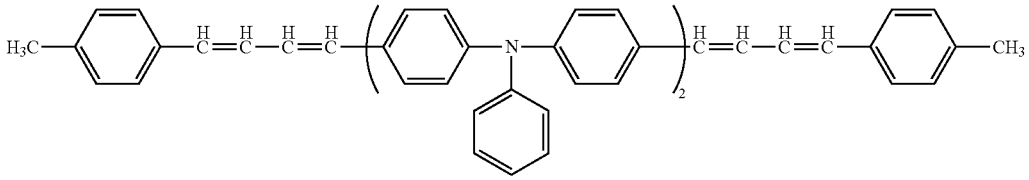
Chemical Formula (A-Ih)
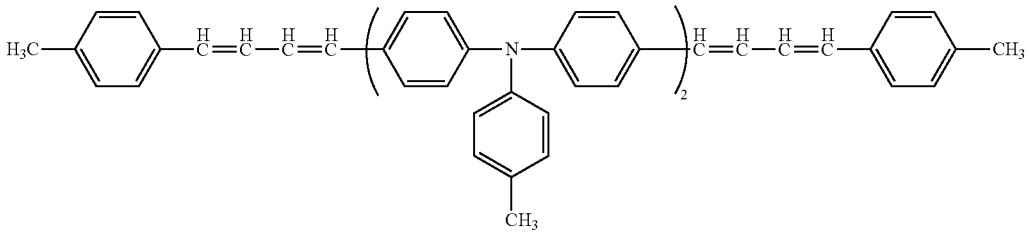
General Formula (B-I)
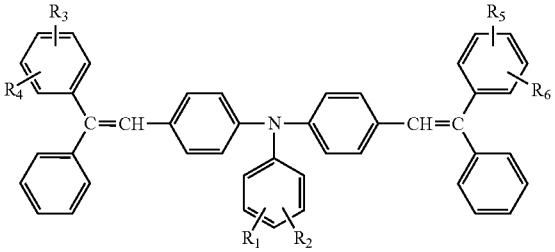
in General Formula (B-I), $R_1$ and $R_2$ each independently represent a C1 to C6 alkyl group and $R_3$ to $R_6$ each independently represent a hydrogen atom, a halogen atom or a C1 to C6 alkyl group which may have a substituent,
General Formula (C-I)
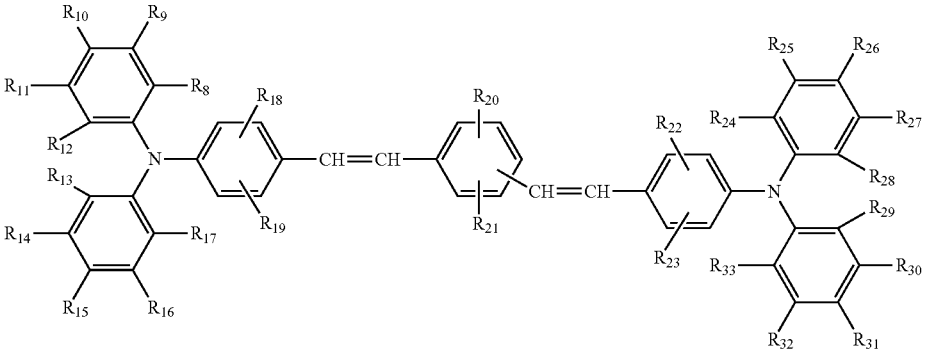

in General Formula (C-I), $R_8$ to $R_{33}$ each independently represent a hydrogen atom, a C1 to C4 alkyl group, a C1 to C4 alkoxy group, or a substituted or unsubstituted phenyl group, and may be identical or different, General Formula (II)

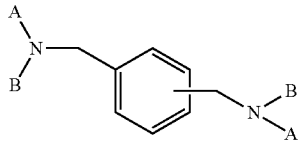

in General Formula (II), A and B each independently represent a group represented by the following formula (I) or (ii), and may be identical or different:

$$—CH_2X \quad \text{formula (I)}$$

$$—CH_2CH_2Y \quad \text{formula (II)}$$

where X and Y each independently represent an aromatic group which may have a substituent.

12. The electrophotographic apparatus according to claim 11, wherein the electrophotographic apparatus is a digital electrophotographic apparatus and the imagewise exposing unit is a LD or LED.

13. The electrophotographic apparatus according to claim 11, wherein the electrophotographic apparatus is a tandem electrophotographic apparatus including two or more of the electrophotographic photoconductor, two or more of the charging unit, two of more of the developing unit and two or more of the transfer unit.

14. The electrophotographic apparatus according to claim 11, further comprising an intermediate transfer member and an intermediate transfer unit, wherein the transfer unit is configured to primarily transfer the toner image formed on the electrophotographic photoconductor onto the intermediate transfer member, to thereby form an image on the intermediate transfer member, and the intermediate transfer unit is configured to secondarily transfer the image formed on the intermediate transfer member onto the recording medium; and wherein, when the image formed on the intermediate transfer member is color images of a plurality of color toners, the transfer unit is configured to transfer the color images onto the intermediate transfer member in a superposed manner, to thereby form an image on the intermediate transfer member, and the intermediate transfer unit is configured to secondarily transfer the image formed on the intermediate transfer member onto the recording medium at one time.

15. A process cartridge for electrophotographic apparatus, comprising:

an electrophotographic photoconductor, and at least one selected from a charging unit configured to charge a surface of the electrophotographic photoconductor, an imagewise exposing unit configured to form a latent electrostatic image on the surface of the electrophotographic photoconductor, a developing unit configured to develop the latent electrostatic image to form a toner image, a cleaning unit configured to clean the surface of the electrophotographic photoconductor, and a transfer unit configured to transfer the toner image directly or via an intermediate transfer member onto a recording medium, wherein the electrophotographic photoconductor comprises a conductive substrate and a photoconductive layer provided over the conductive substrate, wherein the photoconductive layer contains a charge generation agent and a charge transport agent represented by any one of the following Chemical Formulas A-Ic, A-Ie, A-If, A-Ig, A-Ih, General Formula (B-I) or General Formula (C-I), and an amine compound represented by the following General Formula (II):

Chemical Formula (A-Ic)

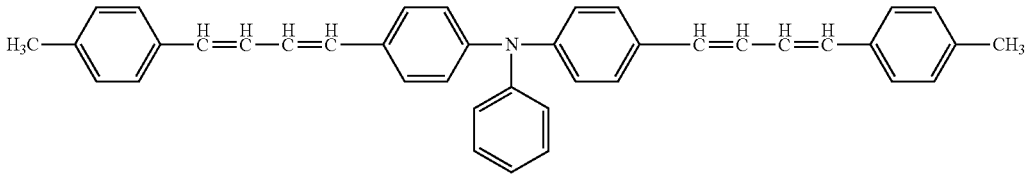

Chemical Formula (A-Ie)

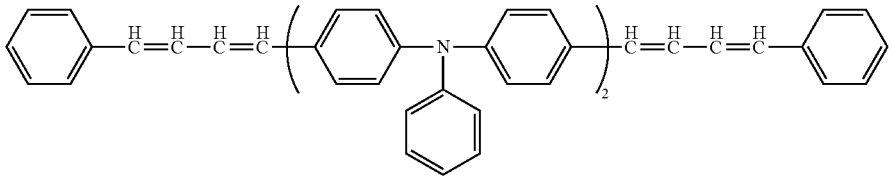

Chemical Formula (A-If)

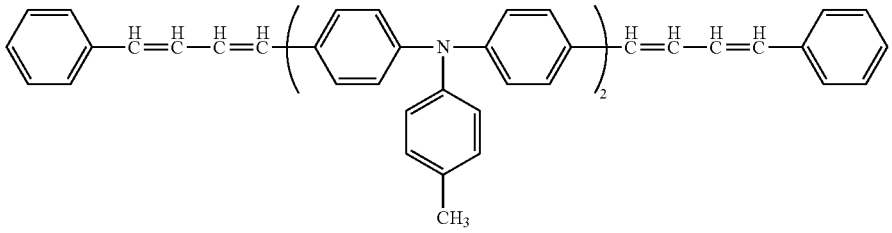

-continued
Chemical Formula (A-Ig)
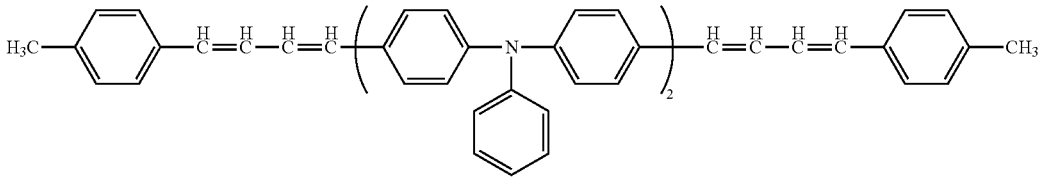
Chemical Formula (A-Ih)
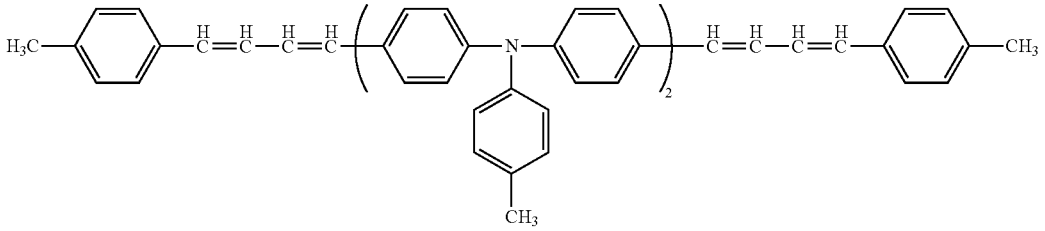
General Formula (B-I)
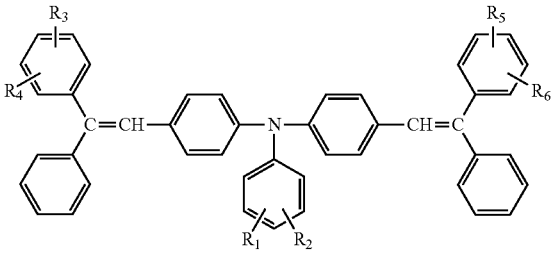
in General Formula (B-I), $R_1$ and $R_2$ each independently represent a C1 to C6 alkyl group and $R_3$ to $R_6$ each independently represent a hydrogen atom, a halogen atom or a C1 to C6 alkyl group which may have a substituent,
General Formula (C-I)
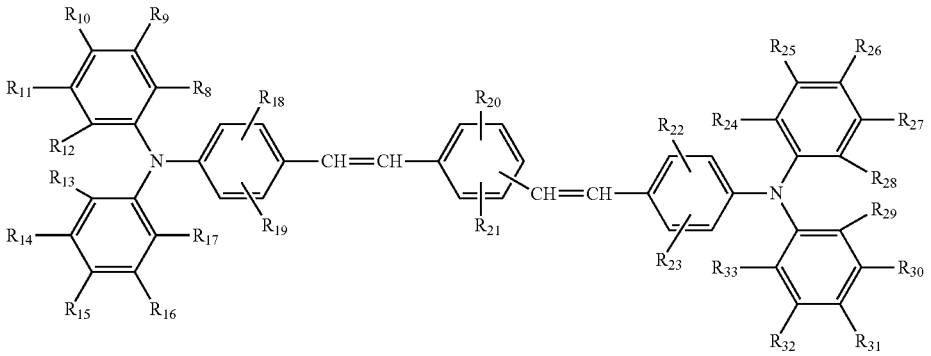

in General Formula (C-I), $R_8$ to $R_{33}$ each independently represent a hydrogen atom, a C1 to C4 alkyl group, a C1 to C4 alkoxy group, or a substituted or unsubstituted phenyl group, and may be identical or different, General Formula (II)

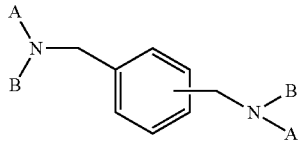

in General Formula (II), A and B each independently represent a group represented by the following formula (I) or (ii), and may be identical or different:

$$—CH_2X \qquad \text{formula (I)}$$

$$—CH_2CH_2Y \qquad \text{formula (II)}$$

where X and Y each independently represent an aromatic group which may have a substituent.

* * * * *